US009738410B2

(12) United States Patent
Wilkins et al.

(10) Patent No.: US 9,738,410 B2
(45) **Date of Patent: *Aug. 22, 2017**

(54) FLUID TRANSPORT CONTAINER

(71) Applicant: 0901601 B.C. LTD., Sorrento (CA)

(72) Inventors: Conrad H Wilkins, Sorrento (CA); Stephen Michael Pears, Toronto (CA)

(73) Assignee: 0901601 B.C. LTD., Salmon Ark (CA)

( * ) Notice: Subject to any disclaimer, the term of this patent is extended or adjusted under 35 U.S.C. 154(b) by 178 days.

This patent is subject to a terminal disclaimer.

(21) Appl. No.: 14/424,105

(22) PCT Filed: Aug. 28, 2013

(86) PCT No.: PCT/CA2013/000749

§ 371 (c)(1),
(2) Date: Feb. 26, 2015

(87) PCT Pub. No.: WO2014/032169

PCT Pub. Date: Mar. 6, 2014

(65) Prior Publication Data

US 2015/0210446 A1 Jul. 30, 2015

Related U.S. Application Data

(63) Continuation-in-part of application No. 13/597,087, filed on Aug. 28, 2012, now Pat. No. 8,950,637.

(30) Foreign Application Priority Data

Aug. 28, 2012 (CA) ..... 2788791

(51) Int. Cl.
*B67D 3/00* (2006.01)
*B65D 1/20* (2006.01)
(Continued)

(52) U.S. Cl.
CPC ..... *B65D 1/20* (2013.01); *B65D 25/44* (2013.01); *B65D 55/16* (2013.01)

(58) Field of Classification Search
CPC ..... B65D 1/20; B65D 25/44; B65D 55/16; B65D 1/14; B65D 1/18; B65D 23/102;
(Continued)

(56) References Cited

U.S. PATENT DOCUMENTS 1,393,331 A * 10/1921 Wilson ..... B65D 25/44 222/525
1,748,680 A * 2/1930 Schrader ..... B65D 25/44 222/129
(Continued)

FOREIGN PATENT DOCUMENTS

JP 10253045 A * 9/1998 ..... F23K 5/14

*Primary Examiner* — Patrick M Buechner
(74) *Attorney, Agent, or Firm* — Antony C. Edwards

(57) ABSTRACT

A fluid transport container is described that comprises a wall and a valve assembly. The wall defines a hollow cavity and an aperture that extends across the wall. An extendable tube is moveable to extend out from the hollow cavity. A biasing member is provided to extend the extendable tube from the hollow cavity. The valve assembly can move between an open position and a closed position to control the flow of fluids from the container. Optionally, a trigger assembly is coupled to the valve assembly to move the valve between the open and closed positions. The trigger assembly comprises a trigger shaft that extends through the wall, to provide a trigger handle that is accessible from outside the hollow cavity. Optionally, the container includes a handle that extends away from an exterior surface of the wall and the trigger handle is positioned between the handle and the wall.

19 Claims, 19 Drawing Sheets

(51) Int. Cl.
*B65D 25/44* (2006.01)
*B65D 55/16* (2006.01)

(58) Field of Classification Search
CPC ..... B65D 23/104; B65D 23/10; B65D 25/28; B65D 25/2811; B65D 25/2826; B65D 25/2882; B65D 25/2885; B65D 25/2894; B65D 25/2897; B65D 25/30; B65D 47/061; B65D 47/205; B65D 47/2093; B65D 83/00; B65D 47/32; B65D 47/283; B65D 47/263; B67D 7/005; B67D 3/0051; B67D 3/0061
See application file for complete search history.

(56) References Cited

U.S. PATENT DOCUMENTS 2,328,020 A * 8/1943 Johnson ..... B65D 47/061 222/488
2,684,181 A * 7/1954 Neuner ..... B65D 47/061 222/482
3,006,506 A * 10/1961 Germano ..... A47J 47/01 222/158
3,717,289 A * 2/1973 Laurizio ..... B65D 47/061 222/481
3,794,235 A 2/1974 Flider
4,022,357 A * 5/1977 Dwinell ..... B65D 47/061 222/537
4,063,667 A 12/1977 Flider
4,069,946 A 1/1978 Flider
4,667,710 A 5/1987 Wu
5,704,408 A 1/1998 Law
6,435,380 B1 8/2002 Raboin
6,478,058 B1 11/2002 Pears
6,976,610 B2 12/2005 Rigel
8,567,646 B1 * 10/2013 Cray ..... B67D 7/005 222/478
8,950,637 B2 * 2/2015 Wilkins ..... B65D 25/44 222/466

* cited by examiner

FLUID TRANSPORT CONTAINER

CROSS REFERENCE TO RELATED APPLICATION

For the purposes of a national phase entry of this PCT application into the United States, this application is a continuation-in-part of U.S. patent application Ser. No. 13/597,087 filed Aug. 28, 2012.

FIELD OF THE INVENTION

The present invention relates to portable containers for liquids. In particular, the present invention relates to containers that incorporate spouts and valves to control the flow of liquid while dispensing of liquids from the container.

BACKGROUND OF THE INVENTION

It is known, when using a fluid containment vessel for applications such as storing and transporting gasoline, that pouring the contents from the vessel may result in spillage due to lack of, or inadequate, flow control of the fluid leaving the vessel. A solution to this problem is to incorporate a manually operable flow control valve to enable the user or operator to control the flow of fluid being poured from the vessel. Parts of many common devices are frequently stored within the vessel, submerged in the fluid in the vessel and require removal by hand so as to be attached externally to the vessel for use in pouring. Consequently, fluid from the vessel may be spilled during this process, contaminating the hands of the operator and the surrounding environment.

In the prior art, as described below by way of example, devices to meter the flow of fluid from a vessel have a significant part of their valve or spout external to the vessel. Such designs may expose the metering valve or spout to damage if the vessel is dropped or struck accidentally.

Ergonomic design is related to the ease of use and the comfort of the operator when using a fluid container. Products in this field frequently do not take into account such ergonomics. A device that is awkward to use may cause an operator to try and find a way to use it comfortably. This may entail using the device differently from how the device was intended and designed to be used. This may lead to dangerous situations if, for example, the vessel contains flammable or corrosive liquids. Hence poor ergonomic design may compromise the operator's safety. The present invention seeks to provide improved safety for the operator.

The prior art the applicant is aware of includes: U.S. Pat. No. 1,393,331 which issued Oct. 11, 1921 to Wilson;

U.S. Pat. No. 3,794,235 which issued to Flider on Feb. 26, 1974;

U.S. Pat. No. 4,063,667 which issued to Flider on Dec. 20, 1977;

U.S. Pat. No. 4,069,946 which issued Jan. 24, 1978 to Eider;

U.S. Pat. No. 4,667,710 which issued May 26, 1987 to Wu;

U.S. Pat. No. 5,704,408 which issued Jan. 6, 1998 to Law;

U.S. Pat. No. 6,435,380 which issued Aug. 20, 2002 to Rabowin;

U.S. Pat. No. 6,478,058 which issued Nov. 12, 2002, to Pears; and,

U.S. Pat. No. 6,976,610 which issued Dec. 20, 2005 to Rigel.

SUMMARY OF THE INVENTION

One aspect provides a container comprising a wall that defines a hollow chamber and an aperture that extends through the wall, and a valve assembly disposed in the aperture. The valve assembly comprises an extendable tube that is moveable between a retracted position wherein the extendable tube is substantially within the hollow chamber, and an extended position wherein at least part of the extendable tube extends through the aperture. A biasing member is coupled to the extendable tube for moving the extendable tube toward the extended position, and means are provided for adjusting a flow rate of liquid dispensed from the extendable tube.

One aspect provides a valved fluid transport container including a hollow vessel having a spout aperture and a first handle oppositely disposed on the vessel to the spout aperture. The first handle has a corresponding handle cavity. The handle cavity has a side wall common with the vessel. The side wall has a shaft aperture therein.

Nested first, second and third tubes are mounted in the spout aperture. Each of the first, second and third tubes have opposite downstream and upstream ends. The downstream and upstream ends have openings therein. The first tube is telescopically nested for first telescopic motion relative to and within the second tube. The third tube is telescopically mounted on, for second telescopic motion relative to the second tube. The second tube is rigidly mounted into the spout aperture so as to be contained within the vessel.

The first and second telescopic motions are along a common centroidal longitudinal axis of the tubes. The longitudinal axis intersects the first handle cavity. A valve shaft is mounted along the longitudinal axis and journalled through the shaft aperture so as to dispose a handle end of the valve shaft in the first handle cavity of the first handle. An opposite hollow end of the valve shaft, opposite to the handle end, is mounted to the third tube whereby translation of the valve shaft along the longitudinal axis translates the third tube between its seal open and seal closed positions. In the seal closed position the third tube is in a lockable position when the first tube is in a corresponding storage position nested in the second tube.

A selectively releasable lock is mounted to, for selectively releasable locking cooperation between the second tube and the third tube when the third tube is in the lockable position. The lock is locked by the telescopic motion of the first tube into the storage position in the second tube so as to engage the lock and whereby the third tube is immobilized relative to the second tube.

A sidewall of the second tube has a fluid-flow aperture formed therein. The second tube also has a first airflow aperture formed therein, upstream of the fluid-flow aperture relative to a direction of fluid flow from the vessel through the first and second tubes when decanting a fluid from the vessel. Downstream and upstream seals are provided on respectively the downstream and upstream ends of the second and third tubes. The seals seal so as to prevent, when the third tube is in the seal closed position, the fluid flow through the fluid-flow aperture, and the first airflow through the airflow aperture respectively.

As the first tube is telescopically extended from the second tube, the downstream end of the first tube extends from the vessel and the upstream end of the first tube disengages so as to unlock the lock. Thereafter translation of the valve shaft into the first handle cavity retracts the third tube from the seal closed position into the seal open position. This unseals the upstream and downstream seals so as to open a fluid path for the fluid flow, whereby the fluid in the vessel flows through both the fluid-flow aperture and the extended first tube to exit from the first tube, and so as to open an airflow path for the airflow through the first and second tubes, through the first airflow aperture, and into the vessel.

The first tube may include an air channel to separate the air flow from the fluid flow and so as to define an airflow path which is separated from the fluid flow path in the first tube.

For sake of providing a frame of reference, the vessel has an upper end and an opposite lower end, and a front end and an opposite back end. Preferably the spout aperture is in the front end and the first handle is on the back end. The tubes have upper sides and opposite lower sides. The air channel may be formed along the upper side of the first tube. For example, the channel may be formed within the first tube.

In one embodiment, the lock includes at least one dog positioned in the second tube so as to be engaged by the first tube when in the storage position. The engagement of the first tube with the at least one dog biases an end of the at least one dog into locking engagement into a female depression such as a slot or groove in the third tube, when in the seal closed position. Each dog may include at least one flexible member, for example a spring arm or the end of a spring.

In one embodiment, a first spring is mounted in the second tube so as to resiliently compress and expand between an upstream end wall of the upstream end of the second tube and the upstream end of the first tube to thereby resiliently bias the first tube to telescopically extend outwardly of the second tube from the storage position. A second spring may be provided which cooperates with the valve shaft to resiliently urge the third tube into the seal closed position. In one embodiment, the second spring cooperates between the valve shaft and the handle side wall.

A spout retainer may be provided for selectively retaining the first tube in the storage position. The spout retainer may include a retainer cap releasably mountable onto, so as to cover, the spout aperture when the first tube is in the storage position.

In one embodiment the valve shaft has a hollow end opposite the handle end. The hollow end is in airflow communication with the third tube. A second airflow aperture is formed in the hollow end of the valve shaft so that the airflow path flows serially through the channel, the second tube, and the hollow end of the valve shaft. Preferably the second airflow aperture is in an upper side of the hollow end.

Preferably the tubes are substantially cylindrical, the hollow end is substantially cylindrical, the fluid-flow apertures are formed respectively in a lower side of the downstream end of the second tube and in a lower side of the upstream end of the first tube. Advantageously, a flashback screen is mounted in the airflow path between the first and second airflow apertures.

In one embodiment the tubes, the valve shaft, the spout aperture, the first handle and the first handle cavity all lie substantially in a common plane, wherein the common plane may substantially bisect the vessel, in which case the vessel may be substantially a mirror image on either side of the common plane.

Further advantageously the downstream end of the first tube is substantially flush with the spout aperture when in the storage position and wherein the handle end is substantially fully contained within the first handle cavity. In the preferred embodiment a second handle is provided lying substantially in the common plane on the upper end of the vessel. The second handle is for lifting and carrying the vessel and for assisting in pouring fluid from the vessel.

In a typical embodiment, a filling aperture is formed in the upper end of the vessel. The second handle may have a corresponding second handle cavity, so that the first handle cavity and the second handle cavity define a passageway therebetween within the vessel. Advantageously the filling aperture is substantially aligned with the passageway so that fluid poured into the vessel may pass between the two handle cavities without obstruction and so that the airflow escaping from the second airflow aperture into the vessel rises through the passageway towards the filling aperture when the vessel is inclined forwardly to thereby tilt the longitudinal axis and the tubes for decanting of the fluid flow. A cap is provided which is releasably mountable onto the filling aperture so as to releasably seal the filling aperture.

The first tube may be a spout. The second tube may be a main valve body. The third tube may be a valve outer sleeve.

Characterized in other words, the valved fluid transport container may be described as including a hollow container having a continuous interior wall. At least one, and preferably two handles are formed on the body of the vessel, which may be manufactured by blow moulding using a high density plastic material suitable for the containment of potentially volatile or corrosive fluids to conform to corresponding required safety standards. A valve is operable between an open position and a closed position upon activation of a trigger device coupled to the valve. A telescoping fluid delivery spout is normally housed in a storage position within a bore of the valve body. The spout and valve assembly may also include a compression spring for the resilient partial ejection of said spout from within the valve body. The valve may further include a means to bias the valve, such as a further spring, to the closed position. The spout and valve assembly may further include a lock to releasably lock the valve in a closed state when the telescoping spout is in its storage position within the bore of the valve.

In a further aspect, the invention may comprise a valve including a main valve body having primary and secondary apertures. An outer valve body such as a sleeve forms seals between, respectively, the primary and secondary apertures of the main valve body and an air passageway in the outer valve body and the fluid in the vessel. A primary seal may be located beside the primary aperture or apertures of the main valve body. The primary seal is engaged by the outer sleeve so as to separate the inner volume of the vessel from the primary apertures in the main valve body. The secondary apertures in the main valve body allow the flow of air into the vessel from the spout and the inner volume of the main valve body. The air flows through the second seal, when opened, which may be located between the outer sleeve and the main valve body, distal to the pouring spout. The air passage may continue into a hollow trigger shaft. The air passage in the hollow trigger shaft continues along the shaft to a vent aperture or port from which the air vents into the vessel. The aperture is at a distance from the valve. Preferably the vent aperture is on the upper side of the shaft. When the vessel is tipped or inclined and when the operator opens the valve in order to pour the fluid from the vessel, the vent aperture in the trigger shaft is positioned close to or adjacent the surface of the fluid being poured inside the vessel. This places incoming air behind the bulk of the outgoing fluid and assists in overcoming the tendency for fluid to exit via the air tube. This incoming air replaces the fluid leaving the vessel and assists by improving the fluid flow rate, overcoming the tendency for a vacuum to form.

The valve is activated via the valve trigger handle. The valve trigger handle is located in the vicinity of the vessel's pouring handle. The trigger handle is attached to the trigger shaft. The design of the trigger handle permits it to be pulled by one or more fingers of the operator's hand holding the pouring handle. The trigger handle may be activated with the use of the left or right hand. The shaft also incorporates guide slots to prevent the rotation of the trigger shaft, keeping the trigger handle in a preferred orientation protected within the pouring handle cavity. The guide slots are engaged by the shaft support boss, to guide the shaft and keep it in the correct orientation. The other end of the trigger shaft is attached to the valve outer sleeve. The trigger activation shaft penetrates the outer wall of the vessel through a sealing device attached to the vessel body in the pouring handle cavity. The sealing device may include a supporting guide boss for the shaft, a compression spring and a resilient sealing boot. The sealing device may be secured to the body of the vessel with a lock washer and nut on the outside of the vessel engaging a post on the boss where the trigger attaches to the shaft.

The resilient boot may be corrugated or accordioned. A small diameter aperture at one end seals around the shaft. The opposite, larger end of the boot mounts to the bushing in the vessel wall. A compression spring is mounted within the boot and around the trigger shaft, butting up against a shoulder on the shaft inside the boot. The other end of the spring presses against the bushing support guide boss. The spring biases the valve to the closed position when the trigger is not activated.

The telescoping pouring spout of the valve system is retained and housed within the bore of the valve main body when not in use. This prevents damage to the spout and limits the chance of foreign contaminates entering the spout's exposed end. When not in use, the spout is normally stored within the valve body, held in place by a spout keeper or retainer that covers its exposed end that may protrude slightly from the outside of the valve cap. The spout keeper is attached to the vessel via a simple tether. The force of the spout ejection spring assists in keeping the spout retainer cap in place.

A boss formation on the vessel body below the valve mounting orifice is used as a locking tab for securing the valve cap. Teeth on the valve cap engage with protuberances, as they pass across the formation on the boss, their ratcheting shape only allowing them to move one way past the boss. The teeth are biased in a direction to allow tightening of the cap but not removal.

The telescoping spout is housed within the main valve body axially to it. Between the bottom of the spout and the bottom of the main valve body a compression spring formation is normally in a compressed state when the spout is within the valve main body. The spring is activated when the spout keeper, that holds the spout within the valve, is released. The released compression spring pushes on the spout to telescope it substantially out of the valve main body so that the spout can be used for dispensing of the fluid from within said vessel. Full ejection of the spout is prevented by the use of a stop such as a spout keeper bushing. The spout keeper bushing is formed with flat faces in its bore that follow similar faces on the spout outer walls. The outer wall of the spout may have a number of such grooves or indented channels running down the outside from the exposed pouring end toward the end retained within the valve. The spout keeper bushing has a tapered upstream bore that engages with the upstream end of the spout which is also tapered preventing the full ejection of the spout. The spout keeper bushing is held in place with the valve retaining cap. When the spout is in the fully extended position, apertures in the sidewall of the spout align with the primary apertures of the valve main body through similar apertures in the spout keeper bushing. When the valve is biased to the open position fluid can flow freely through the aligned apertures, through the bore of the spout and out of the vessel. The air vent passage opens and closes simultaneously with the fluid passage. There is a separate passage formed within the spout to channel air to the back of the spout and into the inner volume of the valve main body, bypassing the fluid apertures. There is a spout spring plug in the upstream end of the spout preventing fluid flowing down the air passage next to the fluid passage. When the trigger activation shaft is pulled the air passage is completed.

A lock locks the valve in a closed position when the telescoping spout is in its stored position within the valve body. The lock may be a simple formation on the bottom of the spout ejection spring. The formation is deflected and displaced by the spout when the spout is pushed fully within the valve body. The formation when displaced is designed to come into contact with the outer valve sleeve and engage in a depression in the inside wall of the outer sleeve. Engaging the formation of the spring with the outer sleeve causes them to lock together and prevent the accidental sliding movement of the outer sleeve if the trigger mechanism is activated.

Alternatively the locking device may be formed by locking dogs formed in the side walls of the second tube, i.e., valve main body that are displaced outwardly into a corresponding cavity formed to receive them in locking engagement therein in the third tube, i.e., the outer sleeve, when the first tube, i.e., the spout is in the stored position.

Other aspects of the invention and details of example embodiments are set forth below.

BRIEF DESCRIPTION OF THE DRAWINGS

FIG. 15*a* showing the spout keeper removed and FIG. 15*b* showing the spout keeper in place, and illustrating the ratcheted safety lock for the valve cap.

DETAILED DESCRIPTION OF THE INVENTION

The following disclosure provides fluid carrying containers and valve assemblies therefor that have a tube which is moveable between an extended position wherein the tube extends from the container for pouring fluid, and a retracted position wherein the tube is substantially within the container. The extendable tube is biased toward the extended position, for example by a spring or the like, and may be held in the retracted position by a cap or other releasable retaining mechanism. One or more fluid flow apertures may be provided near the inner end thereof, and flow control means may be provided to allow the user to adjust the rate of liquid dispensed from the container by varying the extent to which the flow control aperture(s) are uncovered.

The following describes example embodiments wherein the flow control means comprise a second tube within the container that is moveable relative to the extendable tube when the extendable tube is in the extended position, and a trigger is provided to facilitate movement of the second tube in a longitudinal direction with respect to the extendable tube. Other configurations of flow control means are possible in other embodiments, such as for example by rotating the second tube, providing a structure within the container other than a tube which is moveable relative to the extendable tube, or providing means for the user to move the extendable tube relative to a stationary structure within the container that is positioned to block a varying area of the flow control apertures(s) depending on the position of the extendable tube. Also, the example embodiments discussed below are configured for carrying gas or other hydrocarbon fuel, and include certain features that are desirable for such containers, but it is to be understood that other embodiments may have different configurations, and need not be for carrying fuel in all embodiments.

Figure 1:
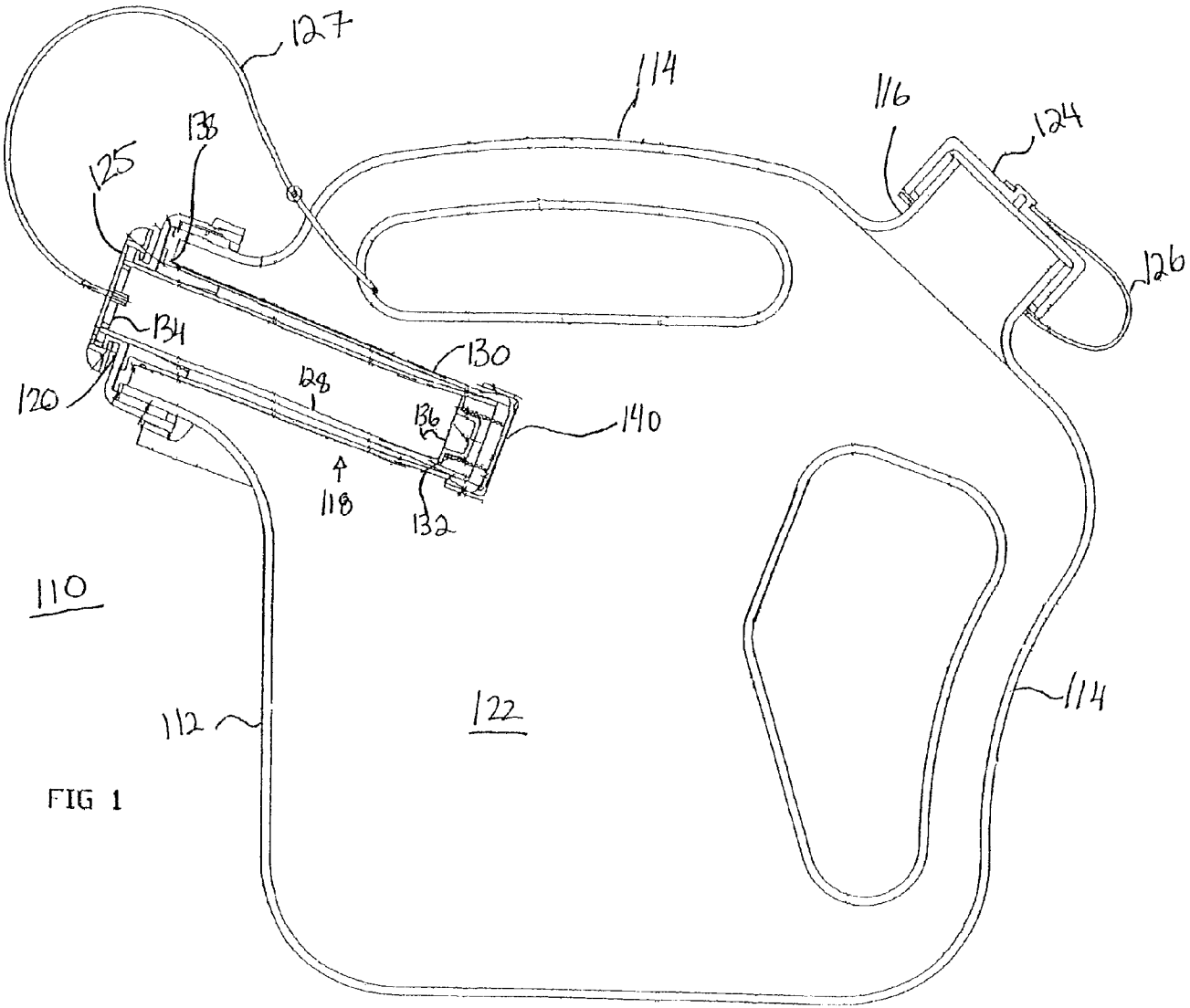
FIG. 1 is a mid-line, cross-sectional side view of an example fuel container.
Figure 2:
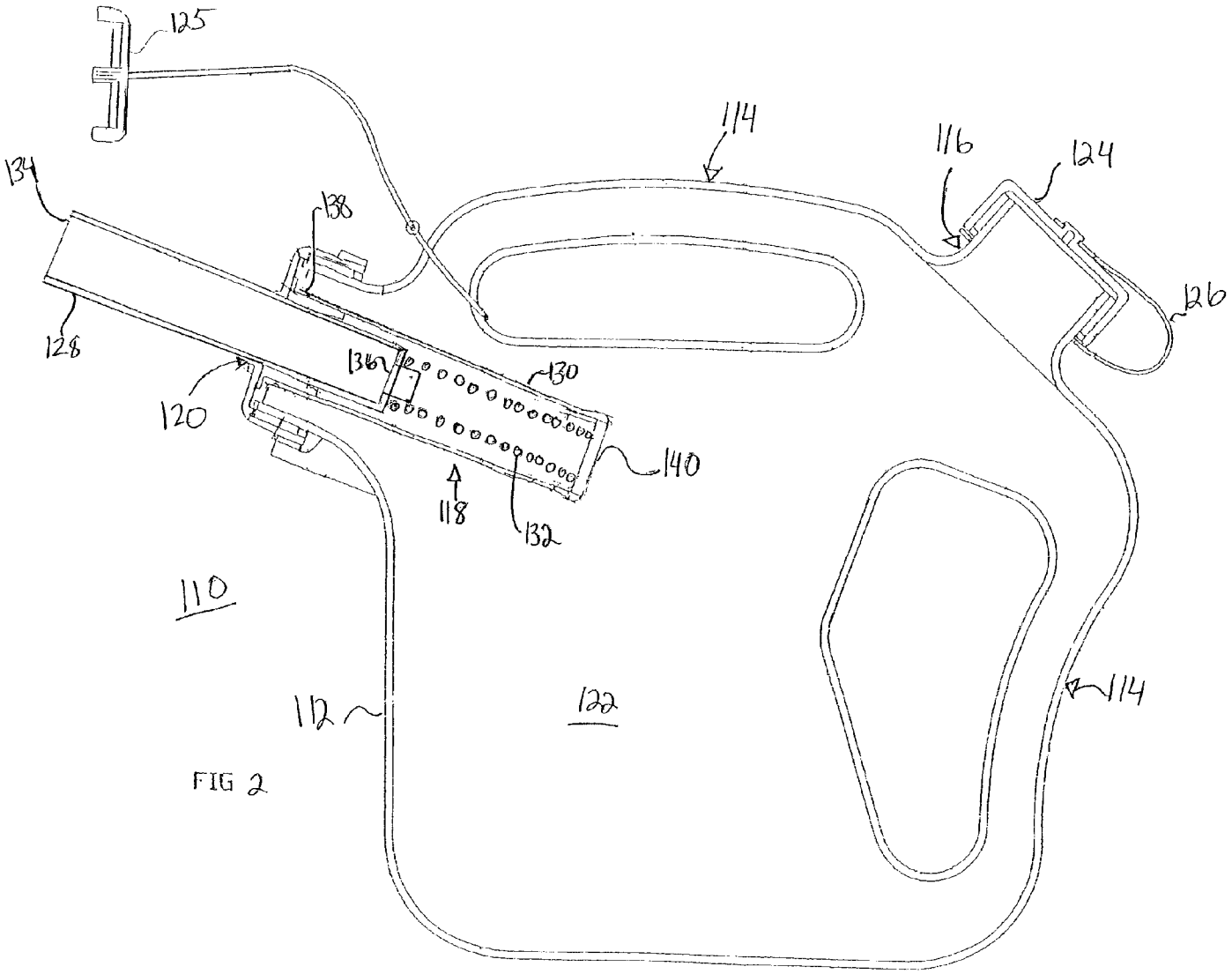
FIG. 2 is a mid-line, cross-sectional side view of the fuel container of FIG. 1, with an extendable tube in an extended position.

FIGS. 1 and 2 depict an example container 110 that comprises a wall 112, two handles 114 and a valve assembly 118. The wall 112 has an internal surface and an external surface. The wall 112 has top, side and bottom portions and the internal surface defines a hollow chamber 122. The wall 112 can be any shape or dimension for receiving liquids, for example hydrocarbon-based fuels, within the hollow chamber 122. The wall 112 is made from a variety of polymers that can be shaped, for example by injection molding and blow molding techniques. Preferably, the polymers do not degrade in the presence of volatile liquids, such as hydrocarbon-based fuels. For example, nylon and polyethylene are suitable polymers.

In the example illustrated in FIGS. 1 and 2, the wall 112 defines a fill port 116 that provides fluid communication between the hollow chamber 122 and outside the container 110. The fill port 116 comprises sidewalls that are formed by extensions of the external surface of the wall 112. Alternatively, the fill port 116 may comprise a hole in the side wall and an annular flange that is secured about the hole. The flange extends away from the external surface of the wall 112 to provide side walls of the fill port 116. The sidewalls provide a surface for connecting a removable fill port cap 124. The fill port cap 124 connects with the fill port 116 to close the fill port 116. For example, the fill port cap 124 can sealably connect by friction fit, snap fit, a threaded connection with an internal or external surface of the fill port 116 sidewalls. Optionally, the fill port cap 124 includes a tether 126 that tethers the fill port cap 124 to a portion of the container 110. In other embodiments, the container may not have a fill port, and could be filled through the aperture 120 described below, for example by removing the valve assembly 118.

The wall 112 defines an aperture 120 that extends through the wall 112 to provide fluid communication between the hollow chamber 122 and outside of the container 110. The aperture 120 may comprise sidewalls that are formed by extensions of the wall 112. The sidewalls may provide a surface for connecting a removable aperture cap 125. Alternatively, the aperture cap 125 may engage the sides of an annular secondary cap attached to the aperture 120, as described below. The aperture cap 125 engages the sidewalls of the aperture 120 (or a secondary cap) to close the aperture 120. For example, the aperture cap 125 can connect by friction fit, snap fit, a threaded connection with an internal or external surface of the aperture 120 sidewalls, and may optionally provide a water- or air-tight seal about the aperture 120. Optionally, the aperture cap 125 includes a tether 127 that tethers the aperture cap 125 to a portion of the container 110.

The handles 114 are formed from portions of the wall 112. Optionally, the one or more handles are hollow with an internal reservoir that communicates with the hollow chamber 122. As a further option of the container 110, one, or more than one, handles 114 are provided.

The valve assembly 118 is housed within the hollow chamber 122. In the illustrated example, the valve assembly 118 comprises an extendable tube 128, a flow rate adjuster or a supporting structure in the form of a second tube 130, and a biasing member 132 in the form of a compression spring. Other embodiments may have a structure for supporting the extendable tube 128 different from the second tube 130, such as, for example an end wall positioned in the interior of the container 110 and held in place by one or more posts (not shown) or the like coupled to the wall 112, such that the biasing member can bear against the end wall. The supporting structure may also guide the movement of the extendable tube 128. Alternatively, movement of the extendable tube may be guided by features built into the wall 112, such as for example a thicker section of the wall 112 adjacent to the aperture 120. The biasing member 132 may also have other configurations. For example, one or more extension springs could be coupled between the extendable tube and the wall 112. The extendable tube 128 has a first end 134 and a second end 136. The first end 134 of the extendable tube 128 is open to permit fluid to be dispensed therefrom. The second end 136 of the extendable tube 128 may be closed or partially open, and may have one or more flow control apertures therein as described below.

The second tube 130 has a first end 138 and an opposite end wall 140. The first end 138 is open and configured to selectively contact the wall 112 around the perimeter of the aperture 120. The end wall 140 is spaced from the first end 138 to allow the extendable tube 128 to be positioned within the second tube 130. The second tube 130 comprises a closed sidewall that extends between the first end 138 and the end wall 140. Alternatively or in addition to the second tube 130, the supporting structure may comprise one or more support arms that extend from the first end 138, or from the internal surface of the wall 112, to support the end wall 140 at a fixed position within the hollow chamber 122.

The extendable tube 128 is moveable between a retracted position and an extended position, as shown in FIGS. 1 and 2 respectively. When in the retracted position both ends of the extendable tube 128 are preferably within the hollow chamber 122, although it is to be understood that in some embodiments a small portion of the first end 134 of the extendable tube 128 may protrude slightly from the aperture 120. In the extended position, the first end 134 of the extendable tube 128 extends through the aperture 120 to outside of the container 110. In the extended position, at least a portion of the extendable tube 128 remains within the hollow chamber 122.

The biasing member 132 biases the extendable tube 128 toward the extended position. In the illustrated example, the biasing member 132 is a coiled spring that is positioned between the second end 136 of the extendable tube 128 and the end wall 140.

When the extendable tube 128 is in the extended position, flow control means may be operated to place the extendable tube 128 in fluid communication with the hollow chamber 122. When the container 110 is tilted to pour liquid, the extended extendable tube 128 directs a flow of liquid from the hollow chamber 122.

In the illustrated example, the aperture cap 125 can be connected to the aperture 120 (or to a secondary cap attached to the aperture 120) to hold the extendable tube 128 in the retracted position against the force exerted by the biasing member 132. This holds the extendable tube 128 in the retracted position within the hollow chamber 122 of the container 110. When the aperture cap 125 is removed, the biasing member 132 moves the extendable tube 128 toward the extended position. In some embodiments, the biasing member 132 may impart only enough force to move the extendable tube 128 part of the way to the extended position, and the user may pull the extendable tube 128 the rest of the way out. Such embodiments advantageously require less force to be applied by the user when returning the extendable tube 128 into the retracted position. In other embodiments, the biasing member 132 may impart enough force to move the extendable tube all of the way into the extended position. While in the extended position, the container 110 can be tilted to pour liquid from the hollow chamber 122 out the first end 134 of the extendable tube 128. Directing a flow of liquid through the extendable tube 128 may be referred to as dispensing.

In other embodiments, different structures can be used to hold the extendable tube 128 in the retracted position against the force of the biasing member 132. For example, a latch (not shown) or the like may be provided on an inner edge of the aperture 120 and may be moved to selectively engage a corresponding feature such as a notch near the first end 134 of the extendable tube 128 to hold the extendable tube 128 in the retracted position.

Figure 3:
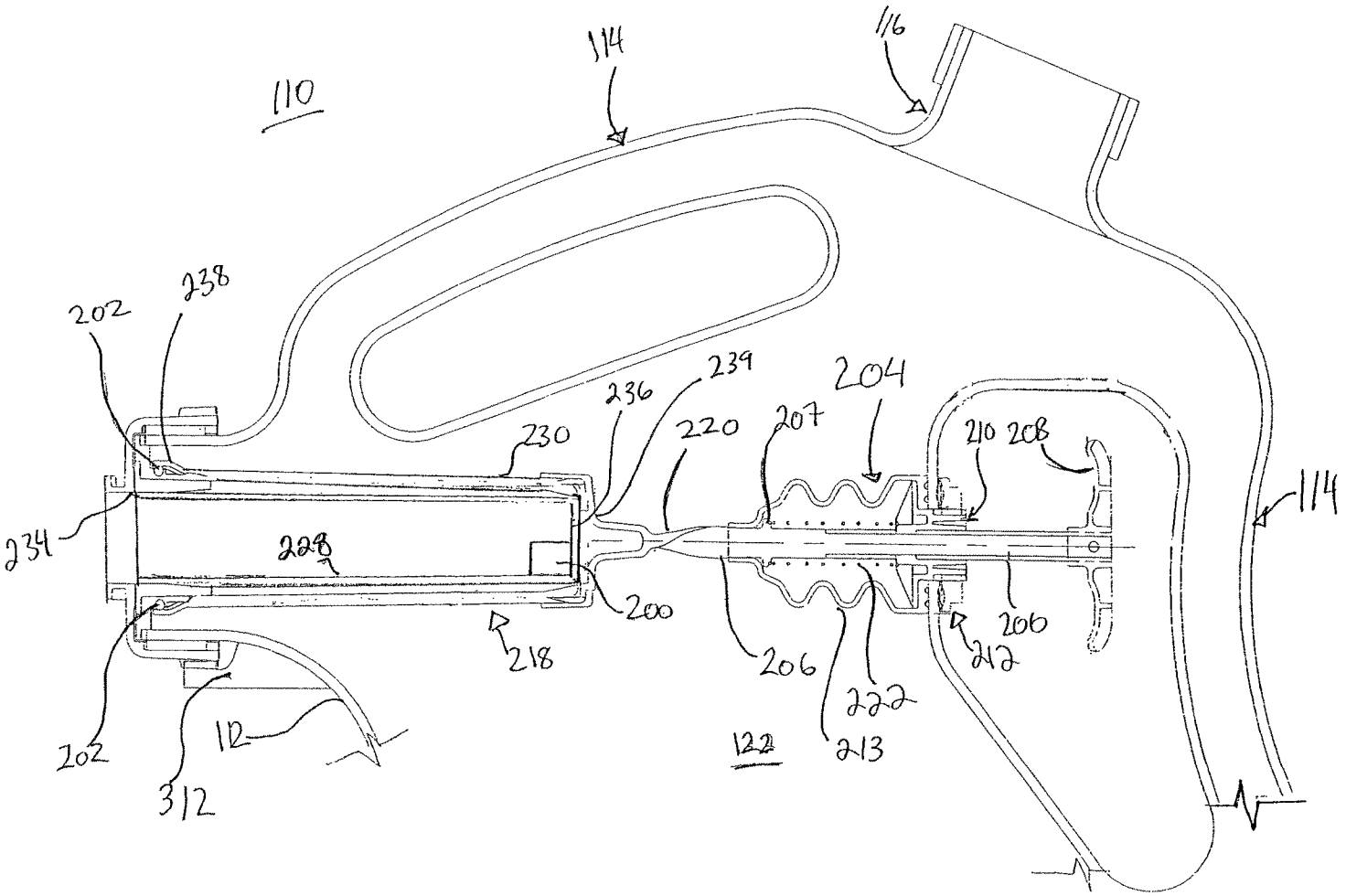
FIG. 3 is a mid-line, cross-sectional side view of a portion of another example fuel container.
Figure 4:
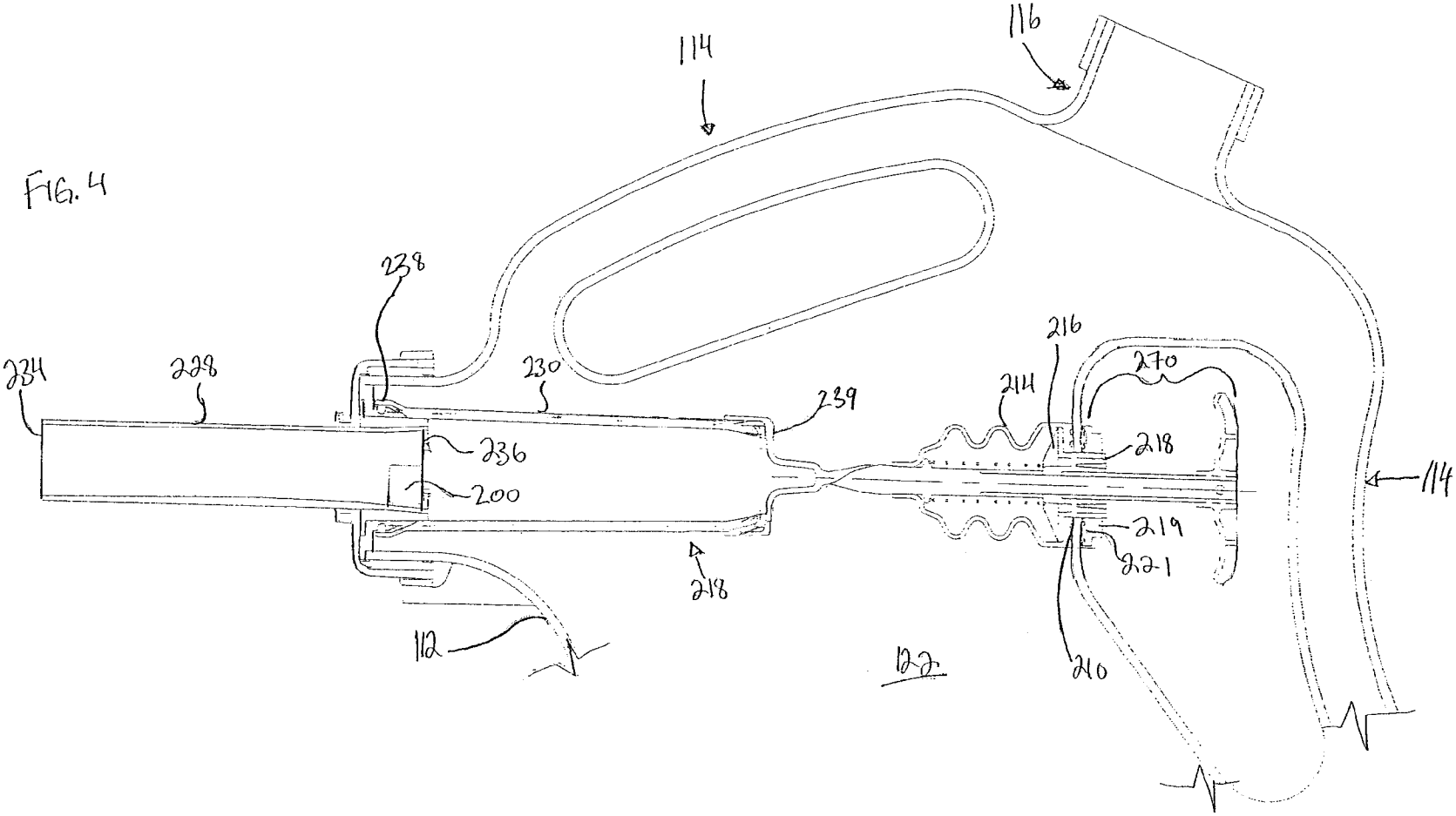
FIG. 4 is a mid-line, cross-sectional side view of the fuel container of FIG. 3, with an extendable tube in an extended position.
Figure 5:
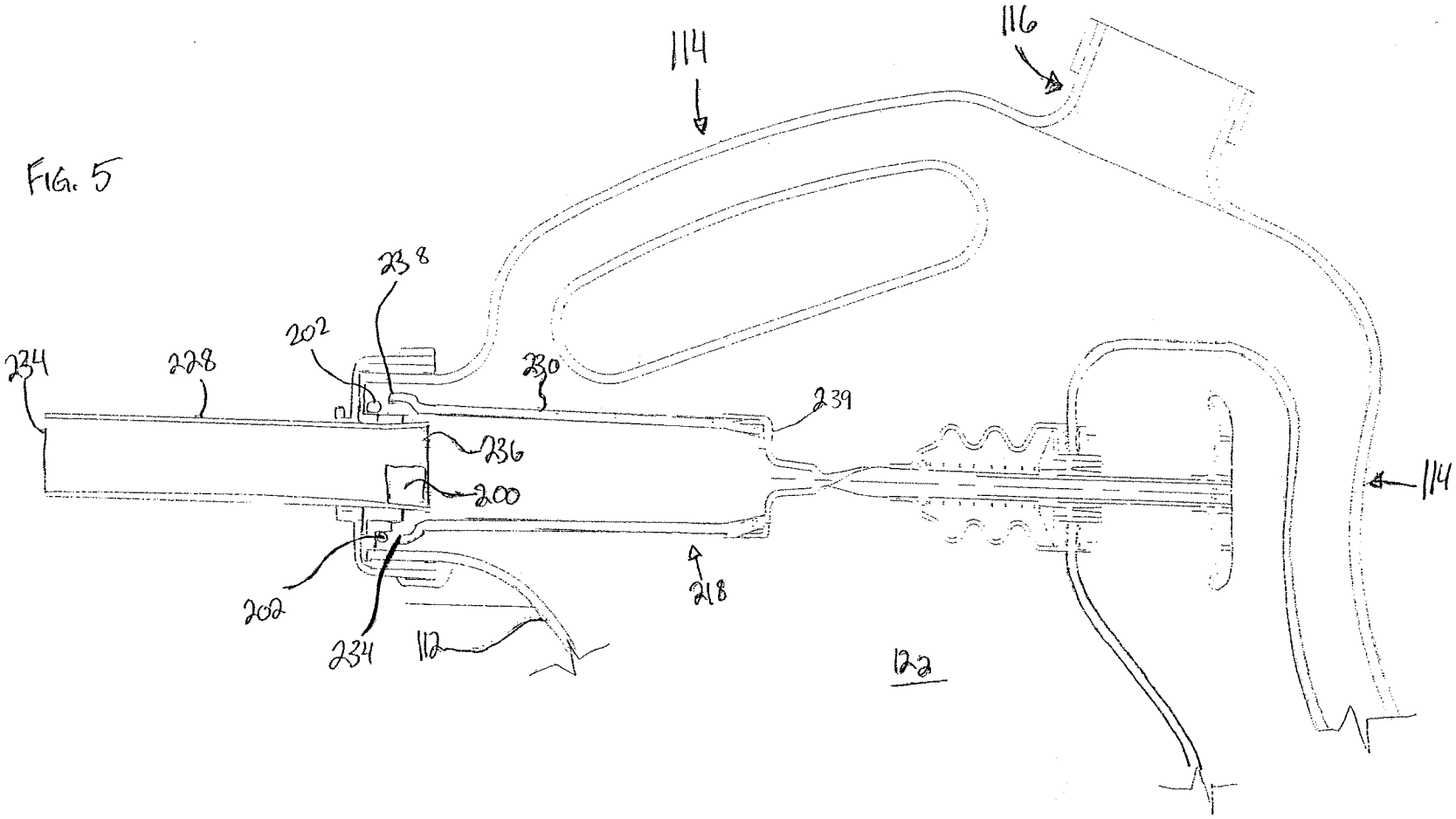
FIG. 5 is a mid-line, cross-sectional side view of the fuel container of FIG. 4 with a valve assembly in an open position.

FIGS. 3, 4, and 5 depict another example of a valve assembly 218 for use with the container 110. FIGS. 3, 4 and 5 depict only a portion of the container 110, in different orientation than the example shown in FIGS. 1 and 2. FIGS. 3, 4 and 5 also do not depict the aperture cap 125, the fill port cap 124, or the biasing member 132.

The valve assembly 218 can control the rate at which fluids are dispensed out of the container 110. The valve assembly 218 may be similar to the valve assembly 118 described above. For example, the valve assembly 218 is housed within the hollow chamber 122 and it comprises an extendable tube 228 and a second tube 230. The extendable tube 228 has a first end 234 and a second end 236. The extendable tube 228 can move between a retracted position and an extended position. A biasing member (not shown) biases the extendable tube 228 into the extended position. In the retracted position, at least a substantial portion of the extendable tube is contained within the hollow chamber 122. For example, in some embodiments both the first and second ends 234, 236 of the extendable tube 228 are positioned within the hollow chamber 122 in the retracted position (see FIG. 3). In the extended position, at least part of the extendable tube 228 extends through the aperture 120 to outside of the container 110 (see FIG. 4). For example, the first end 234 extends outside of the container 110 and the second end 236 may remain inside the container 110.

The extendable tube 228 includes a fluid flow aperture 200. The fluid flow aperture 200 is positioned near the second end 236 of the extendable tube 228. The fluid flow aperture 200 allows liquid from the hollow chamber 122 to enter internal space of the extendable tube 228. In the illustrated example, liquid that enters the flow control aperture 200 passes through an internal space of the second tube 230, such that the position of the second tube can be adjusted to control the flow rate of liquid being dispensed. Optionally, there can be two or more fluid flow apertures 200, and the location and shape of the fluid flow aperture(s) 200 may vary depending on the structure used to support the extendable tube 228 and the mechanism used to control the flow rate, if any, as described further below.

The second tube 230 has a first end 238 and an opposite end wall 239. The first end 238 is configured to selectively abut to the internal surface of the wall 112 and positioned about the aperture 120. The second tube 230 can move between a closed position and an open position. When the second tube 230 is in the closed position, the first end 238 abuts the internal surface of the wall 112 and there is no fluid communication between the hollow chamber 122 and the internal space of the second tube 230 (see FIGS. 3 and 4). When in the open position, the first end 238 is distanced from the internal surface of the wall 112 and there is fluid communication between the hollow chamber 122 and the internal space of the second tube 230 (see FIG. 5). When the second tube 230 is in the open position fluid may flow from the hollow chamber 122, into the second tube 230, through the fluid flow aperture 200 and into the extendable tube 228.

In one option of the container 110, the valve assembly 218 further comprises a seal 202 that is positioned between the first end 238 of the second tube 230 and the wall 112 around the aperture 120, or other features extending from the wall 112 around the aperture. The seal 202 can be an annular seal that is fixed on the inner surface of the wall 112 (or features extending from the wall 112) around the aperture 120, proximal to the first end 238 of the second tube 230. When the second tube 230 is in the closed position, the seal 202 contacts the first end 238 of the second tube 230 to prevent liquid from entering the second tube 230.

When in the open position, the first end 238 of the second tube 230 is distanced from the wall 112 and a fluid pathway opens between the hollow chamber 122 and the internal space of the second tube 230. Fluid that enters the internal space of the second tube 230 can flow through the fluid flow aperture 200 and into the internal space of the extendable tube 228. The distance between the first end 238 of the second tube 230 and the wall 112 can be varied to change the dimensions of the fluid flow path, which in turn may control the rate at which liquid is dispensed from the container 110 through the extendable tube 228.

In other embodiments, different structures may be provided to selectively open the fluid flow path when the extendable tube 228 is in the extended position, and/or control the flow rate. For example, in some embodiments the extendable tube 228 may be rotated to align the fluid flow aperture(s) 200 with one or more corresponding apertures in the second tube 230 or other supporting structure.

In the illustrated example, a trigger assembly 204 is provided for actuating the valve assembly 218 between the open and closed positions. For example, the trigger assembly 204 comprises a trigger shaft 206 with one end that is coupled to the second tube 230 and the other end of the trigger shaft 206 is connected to a trigger handle 208. The trigger shaft 206 extends from the second tube 230, through the hollow chamber 122, and passes through a trigger shaft aperture 210 in the wall 112. The trigger handle 208 is positioned outside of the container 110. The trigger handle 208 is located near the handle 114 of the container 110 in the illustrated example, but this is not necessary in all embodiments.

In other embodiments, other mechanisms may be provided to actuate the valve assembly 218, depending on the structures provided for opening the fluid flow path when the extendable tube 228 is in the extended position, and/or control the flow rate. For example, a dial may be provided at a convenient location on the exterior of the container 110 and coupled to the extendable tube 228 (either directly or by one or more gears or the like) for effecting rotational movement of the extendable tube 228.

Optionally, the container 110 further comprises a sealing arrangement 212 that prevents the communication of fluids through the trigger shaft aperture 210. FIGS. 3 to 6 and 8 depict one example of the sealing arrangement 212 that comprises a sealing boot 213. One end of the sealing boot 213 is sealingly fit about the trigger shaft 206. The other end of the sealing boot 213 is sealed to the internal surface of the wall 112, around the trigger shaft aperture 210. Optionally, the sealing boot 213 can be clamped between a bushing 216 and the wall 112 by a threaded post 218 that extends through the trigger shaft aperture 210 (see FIG. 4). A nut 219 is threaded onto the threaded post 218 to clamp a washer 221 against the wall 112. Alternatively, the sealing arrangement 212 can comprise various other seals that prevent the communication of fluids through the trigger shaft aperture 210. In one embodiment, in order to accommodate the trigger assembly 204 and the sealing arrangement 212, a portion of the wall 112 proximate to the trigger shaft aperture 210 is more rigid than other portions of the wall 112.

Actuating the trigger assembly 204 moves the valve assembly 218 between the open and closed positions. For example, pulling on the trigger handle 208 will cause the second tube 230 to move to the open position and pushing the trigger handle 208 will cause the second tube 230 to move to the closed position, or vice versa. As another example of the trigger assembly 204, the trigger assembly 204 further comprises a gear assembly (not shown) and the trigger handle 208 comprises a rotatable wheel. The gear assembly translates rotation of the rotatable wheel into linear movement of the trigger shaft 206. Alternatively, the rotatable wheel may be configured such that rotation of the rotatable wheel causes rotation of the trigger shaft 206, which in turn moves the valve assembly 218 between the open and closed positions (for example by rotating the second tube 230 to align one or more apertures therein with the flow control aperture(s) 200 in the extendable tube 228).

In one option of the trigger assembly 204, an operator can operate the trigger assembly 204 to regulate the rate at which fluids flow through the valve assembly 218 and out of the container 110. For example, pulling the trigger handle 208 the entire distance that is allowed within the physical dimensions of the container 110 will provide a maximum flow rate of fuel through the valve assembly 218. In contrast, by pulling the trigger handle less than the entire distance will provide a slower flow rate of fuel through the valve assembly 218. Likewise, in embodiments with a rotatable wheel or dial, the amount of rotation may be varied to control the flow rate.

Fluctuations in ambient temperatures may cause the walls 112 to distort and change shape, which may cause the trigger assembly 204 to move from a position that is aligned along the same plane as the first and second tubes 228, 230, to a position that is not aligned. Preferably, at least a portion of the trigger shaft 206 remains on the same plane as the first and second tubes 228, 230. In one example of the trigger assembly 204, the trigger shaft 206 comprises a deformable feature 220. The deformable feature 220 allows one or more sections of the trigger shaft 206 to deviate from the plane it shares with the first and second tubes 228, 230, while maintaining the coupling relationship with the second tube 230. In one example, the deformable feature 220 is a flat, twist feature that is positioned between the valve assembly 218 and the sealing assembly 212 (as shown in FIG. 3). If the trigger shaft 206 deviates from the same plane as the first and second tubes 228, 230, for example because one or more portions of the wall 112 deform, the flat, twist feature allows the trigger assembly 204 to maintain the operational relationship with the valve assembly 218. Alternatively, the deformable feature 220 may be a coil (not shown) or series of restrictions (not shown) that impart a greater flexibility in the trigger shaft 206 without impairing the ability of the trigger assembly 204 to actuate the valve assembly 218 between the open and closed positions.

Optionally, the trigger assembly 204 may further comprise a biasing feature 222 that biases the valve assembly 218 to the closed position. For example, the biasing feature 222 can be a compression spring that is positioned about the trigger shaft 206. One end of the compression spring abuts the sealing assembly 212 or the internal surface of the wall 112, and the other end of the compression spring abuts a shoulder 207 on the trigger shaft 206.

In use, when the operator pulls the trigger handle 208, the trigger shaft 206 moves the valve assembly 218 to the open position, which compresses the biasing feature 222. When the operator releases the trigger handle 208, the biasing feature 222 moves the trigger shaft 206, by acting on the shoulder 207, to move the valve assembly 218 back to the closed position.

In a further option of the container 110, air can flow into the hollow chamber 122 at the same time as fluid is dispensed therefrom. An airflow regulator or an airflow system regulates the flow of air into and out of the container 110. In the context of this disclosure, the term "air" refers to atmospheric air and a mix of atmospheric air and any other gases that are contained within the hollow chamber 122.

Figure 6:
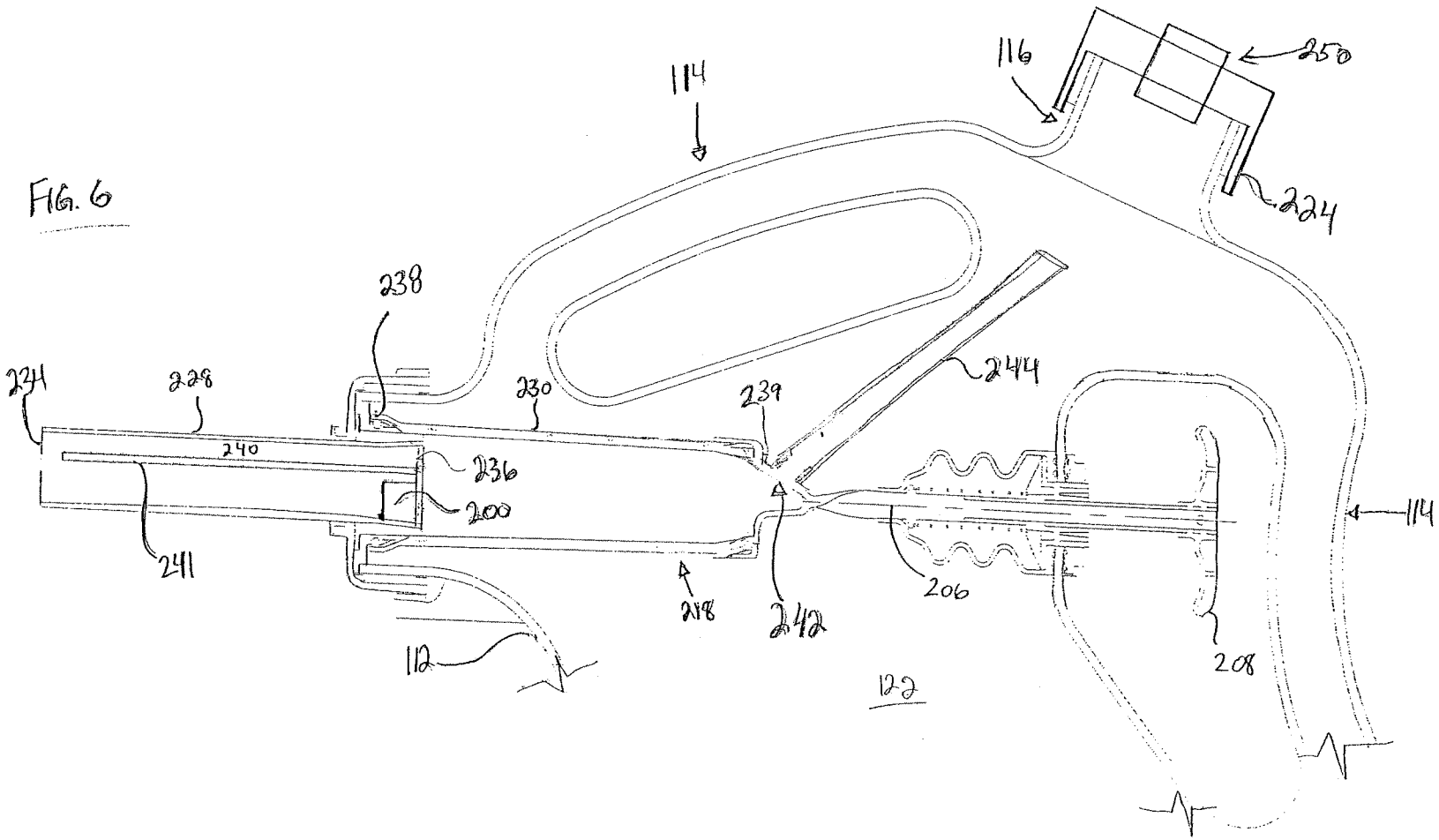
FIG. 6 is a mid-line, cross-sectional side view of the fuel container of FIG. 4 with an airflow channel.

In one option of the airflow system, the extendable tube 228 comprises an internal air channel 240 that is defined by a separation wall 241, as shown in FIG. 6. The separation wall 241 extends from the second end 236 towards first end 234. The separation wall 241 separates the inward flow of air within the air channel 240 from the flow of liquid that is within the extendable tube 228. The air channel 240 may, for example, extend parallel to the internal surface of the extendable tube 228, and may terminate at an airflow aperture (not shown) at the second end 236 of the extendable tube 228. The separation wall 241 may extend all the way to the first end 234 of the extendable tube 228 in some embodiments, or may stop short of the first end 234 in some embodiments.

The air within the air channel 240 flows from the extendable tube 228 into the second tube 230, and out of the second tube 230 through an air escape port 242. Optionally, an air extension tube 244 can be connected to the air escape port 242 to direct the flow of incoming air to a desired portion of the hollow chamber 122. For example, the air extension tube 244 may direct the incoming air to an upper portion of the hollow chamber 122 that is distanced away from the aperture 120. Alternatively, the air extension tube 244 may direct incoming air into any other suitable location.

In another example of the airflow system, the flow of air into, and out of, the hollow chamber 122 may alternatively, or additionally, be regulated by a bidirectional valve assembly 250. The bidirectional valve assembly 250 can be configured to maintain the pressure within the hollow chamber 122 at no more than a predetermined level. The predetermined pressure level may be a value determined by regulated standards for fuel containers. For example, the Canadian Standards Association mandates that a pressure of 20 p.s.i. be maintained in a fuel container at a temperature or 70 C for 4 hours. The bidirectional valve assembly 250 provides an air outlet that allows the operator to manually equilibrate the pressure between the hollow chamber 122 and outside the container 110. The bidirectional valve assembly 250 also provides an air inlet that allows air to enter the hollow container 110 when liquids are dispensed from the container 110. Dispensing liquids from the container creates a vacuum, for example 0.1 p.s.i., within the hollow chamber 122. This vacuum is sufficient to open the bidirectional valve assembly 250 and permit the flow of air into the hollow chamber 122. The bidirectional valve 250 can be positioned at various positions on the wall 112. Preferably, the bidirectional valve 250 is housed within the fill port cap 124, 224.

Figure 7:
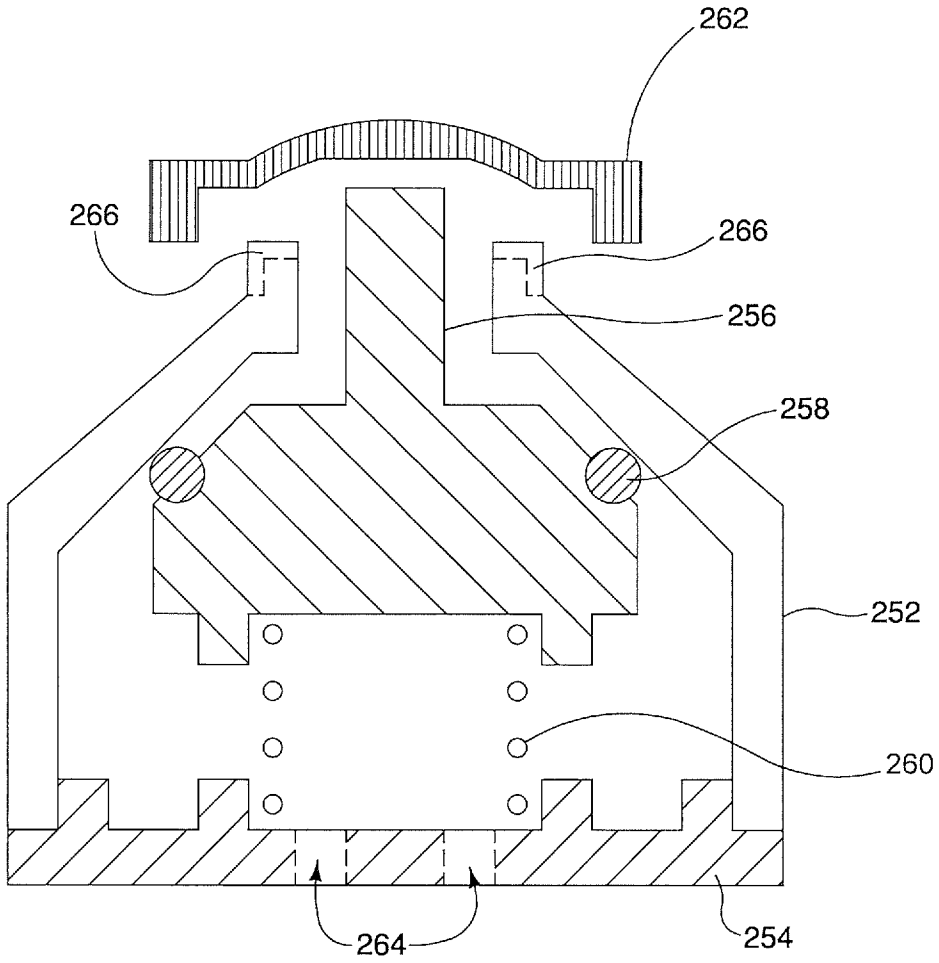
FIG. 7 is a mid-line, cross-sectional side view of a bidirectional valve system for use with the fuel container of FIGS. 1 and 3.

FIG. 7 depicts one example of the bidirectional valve assembly 250 that comprises a valve body 252, a base plate 254, a plunger 256, a gasket 258, a spring 260, and a top cap 262.

The valve body 252 has an open bottom portion, an open top portion, and a sidewall. The sidewall converges towards the open top to form a shoulder and a neck region of the valve body 252. The sidewalls of the valve body 252 are connected to the fill port 116 by a threaded connection. Alternatively, the valve body 252 can be connected to the fill port 116 by plastics welding, chemical bonding adhesives, snap fit, press fit or combinations thereof. The neck region of the valve body 252 includes venting slots 266 that provide fluid communication for air to pass between the valve body 252 and outside the bidirectional valve assembly 250.

The base plate 254 is fixed in the open bottom of the valve body 252. The base plate 254 comprises one or more venting apertures 264 (shown in stippled lines) to allow air to communicate from the hollow chamber 122 to inside the valve body 252.

The plunger 256 is housed within the valve body 252. The plunger comprises an extended portion and a body portion. The extended portion extends through the neck of the valve body 252 and past the upper edge of the valve body 252. The body portion remains below the shoulder of the valve body 252.

The gasket 258 is positioned on the body portion to form a seal against the shoulder of the valve body 252. For example, the gasket 258 can be an O-ring seal.

The spring 260 is positioned between the base plate 254 and the body portion of the plunger 256. The spring 260 pushes the plunger 256 upwards to form a seal between the gasket 258 and the shoulder of the valve body 252.

The top cap 262 is positioned over the neck region of the valve body 252 and the top cap is in close proximity to the top of the extended portion of the plunger 256. Optionally, the top cap 262 is tethered to a portion of the fill port 116 or the external surface of the wall 112.

In use, the operator can press down on the top cap 262 to contact the top cap 262 with the plunger 256. This contact pushes the plunger 256 towards the base plate 254 and breaks the seal between the gasket 258 and the shoulder of the valve body 252. If the pressure of the air within the hollow chamber 122 is greater than the ambient pressure, air will flow from the hollow chamber 122 through the one or more venting apertures 264, past the body portion of the plunger 256 and out the venting slots 266.

When liquid is dispensed from the hollow chamber 122, the vacuum that is created is strong enough to overcome the spring 260 and ambient air is drawn between the top cap 262 and the neck region of the valve body 252 through the venting slots 266 and venting apertures 264, into the hollow chamber 122.

In the illustrated examples, when the extendable tube 128, 228 is in the retracted position the valve assembly 118, 218 is protected from physical damage because it is contained within the geometric footprint of the container 110. In the context of this application, the phrase "contained within the geometric footprint of the container 110" refers to a configuration where a particular structure does not extend beyond a peripheral section of the wall 112, including the handles 114. This configuration allows the wall 112 or the handles 114 to decrease the incidence of accidental damage to the valve assembly 118, 218. Optionally, the portion of the trigger shaft 206 and the trigger handle 208 that are located outside of the hollow chamber 122, referred to as the exterior portions 270 of the trigger assembly 204, may also be positioned within the geometric footprint of the container 110. For example, the exterior portions 270 can be positioned between one of the handles 114 and the external surface of the wall 112. While the inventors have contemplated various configurations a preferred configuration has the exterior portions 270 positioned between the external surface of the wall 112 and the handle 114 that is located opposite to the aperture 120.

Figure 8B:
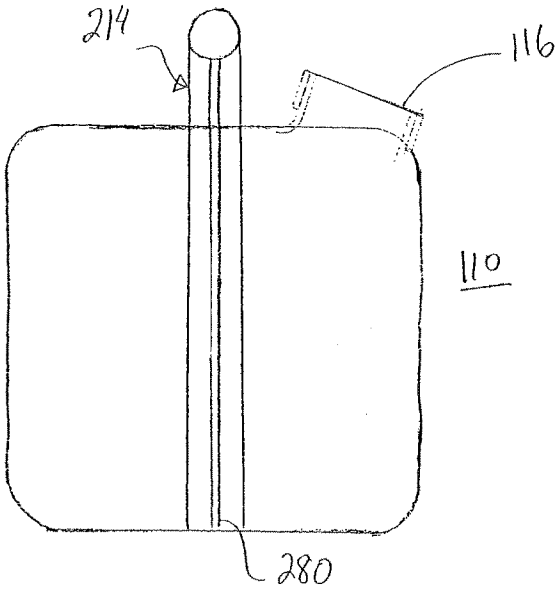
FIG. 8*b* is a rear, elevation view of the fuel container of FIG. 8*a*.
Figure 8A:
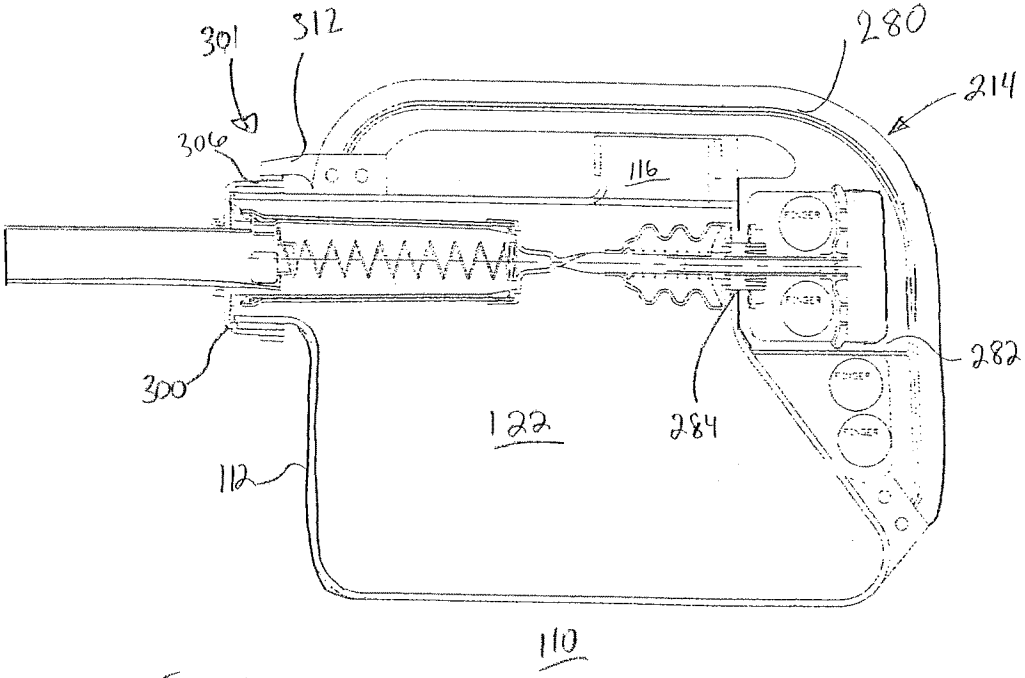
FIG. 8*a* is a mid-line, cross-sectional, side view of another example fuel container.

The valve assembly 118, 218 can be oriented at various angles relative to the bottom portion of the wall 112 (compare FIGS. 1 and 8*a*). In some embodiments, the valve assemblies 118, 218 are oriented substantially parallel with the bottom portion of the wall 112 (as shown in FIG. 8*a*). In a preferred option of the container 110, the valve assembly 118, 218 is in the substantially parallel position and the valve assembly 118, 218 is positioned above a nominal volume level of the container 110. The nominal volume level of the container 110 represents the maximum volume of liquid that the container 110 is designed to hold. According to fuel container regulations, the nominal volume level of the container 110 is indicated on the external surface of the wall 112. In this preferred position, the valve assembly 118, 218 is not submersed in the liquid hydrocarbon based fuel when the container 110 is standing upright and filled to the nominal volume level.

FIGS. 8*a* and 8*b* depict another option of the container 110 that comprises a handle 214 made separately from the wall 112. The handle 214 is more rigid than the wall 112. For example, the handle 214 comprises a plurality of reinforcing ribs 280 that contribute to the rigidity of the handle 214. The reinforcing ribs 280 may extend from one, or a combination, of the handle's 214 top surface, bottom surface, and side surfaces. The reinforcing ribs 280 may extend the entire length of the handle 214, or not. The handle 214 can be made from the same polymeric materials as the wall 112. Alternatively, the handle 214 is made not with reinforcing ribs but with a greater amount of polymeric materials so that the handle 214 is thicker than the wall 112. As a further alternative, the handle 214 is made from materials that are more rigid than the polymeric materials of the wall 112. The handle 214 is connected to the external surface of the wall 112 by various methods including, but not limited to: plastics welding, chemical bonding, use of one or more adhesives, use of connectors (such as rivets, bolts, pins) or combinations thereof.

The handle 214 can further comprise a D-shaped support 282 that defines a second trigger shaft aperture 284. The D-shaped support 282 is positioned adjacent the external surface of the wall 112. The second trigger shaft aperture 284 is positioned to align with the trigger shaft aperture 210 and to receive a portion of the trigger shaft 206 therethrough. As a further option, the cross-sectional shape of the trigger shaft aperture 210, and the second trigger shaft aperture 284, matches the cross-sectional shape of the portion of the trigger shaft 206 that articulates through the trigger shaft aperture 210 and the second trigger shaft aperture 284. This cross-sectional shape matching can be configured to prevent rotation of the trigger shaft 206 about its longitudinal axis so that the trigger handle 208 remains within the geometric footprint of the container 110.

Figure 9:
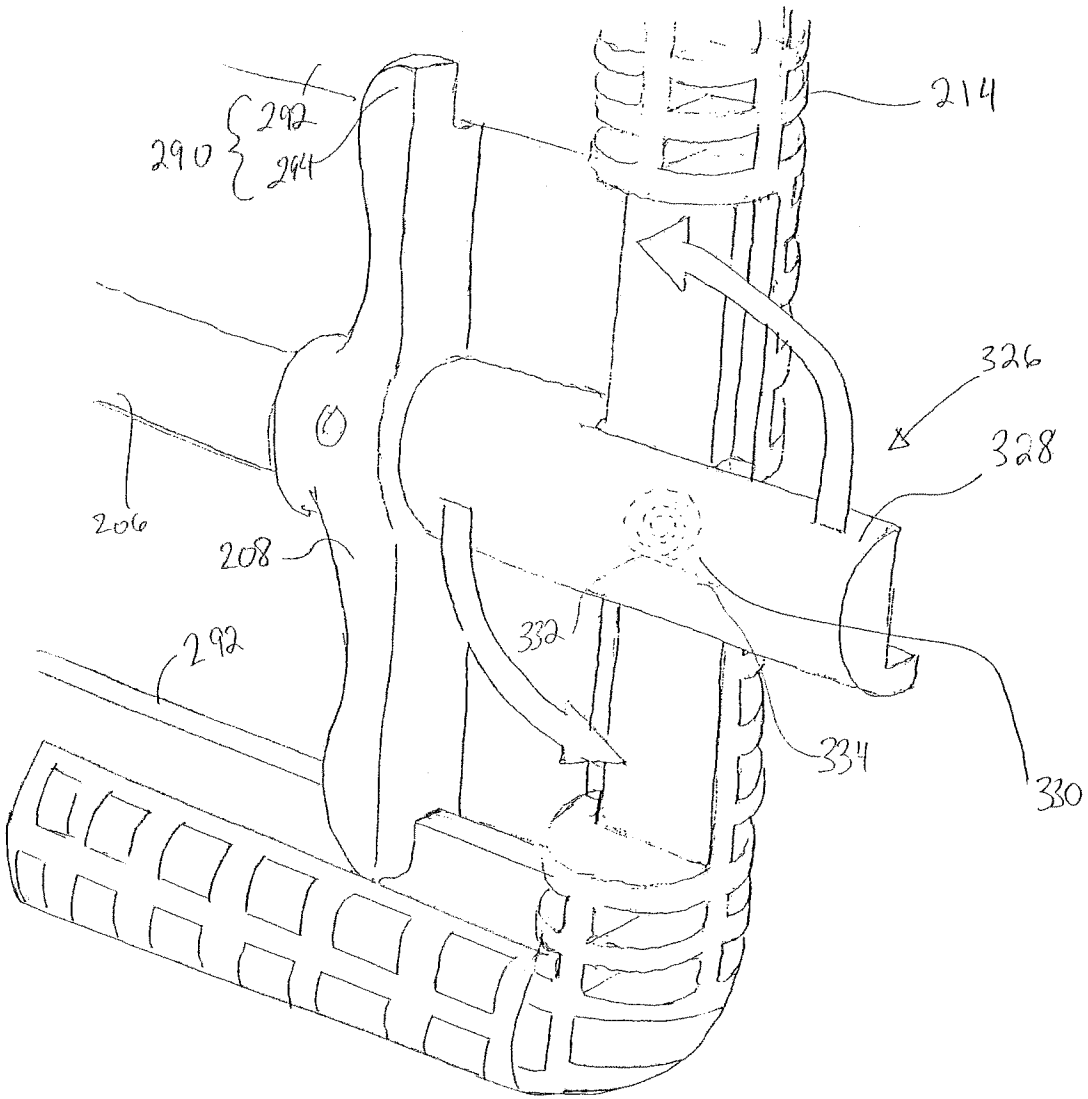
FIG. 9 is an isometric view of an example trigger guide and an example trigger lock for use with any of the fuel containers of FIGS. 1, 3 and 8*a*.

In another option of the container 110, the trigger assembly 204 further comprises a trigger guide assembly 290 that maintains the alignment of the trigger shaft 206 along a preferred path of travel (FIG. 9). For example, the trigger guide assembly 290 can restrict the movement of the trigger assembly 204 within the preferred path of travel that is in the same plane as the valve assembly 218. The trigger guide assembly 290 may also be configured to prevent the trigger shaft 204 from rotating about its longitudinal axis.

For example, the trigger guide assembly 290 may comprise a handle portion 292 and a matching trigger portion 294. The handle portion 292 is positioned on an interior surface of the handle 114, 214. For example, the handle portion 292 is positioned on either, or both, of a top portion and a bottom portion of the interior surface of the handle 114, 214. The trigger portion 294 is connected to, or an integral part of, the trigger handle 208. The trigger portion 294 mates with the handle portion 292 to restrict the movement of the trigger handle 208 along the preferred path of travel.

FIG. 9 depicts one example of the trigger guide assembly 290 where the handle portion 292 is a ridge that extends away from the interior surface of the handle 114, 214 and the trigger portion 294 is a groove, for example a U-shaped groove with two lateral extensions. The U-shaped trigger portion 294 mates with the ridge of the handle portion 292 and any movement of the trigger shaft 206 and the trigger handle 208 is restricted to actuating, towards and away from the valve assembly 118, 218 along handle portion 292.

Figure 10A:
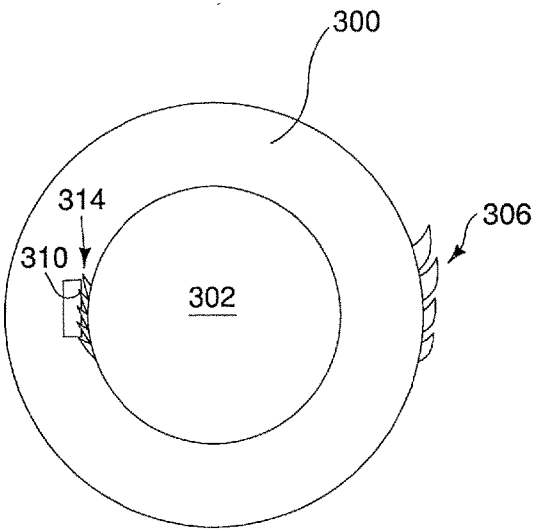
FIG. 10*a* is, in plan view, the cap of FIG. 10.
Figure 10:
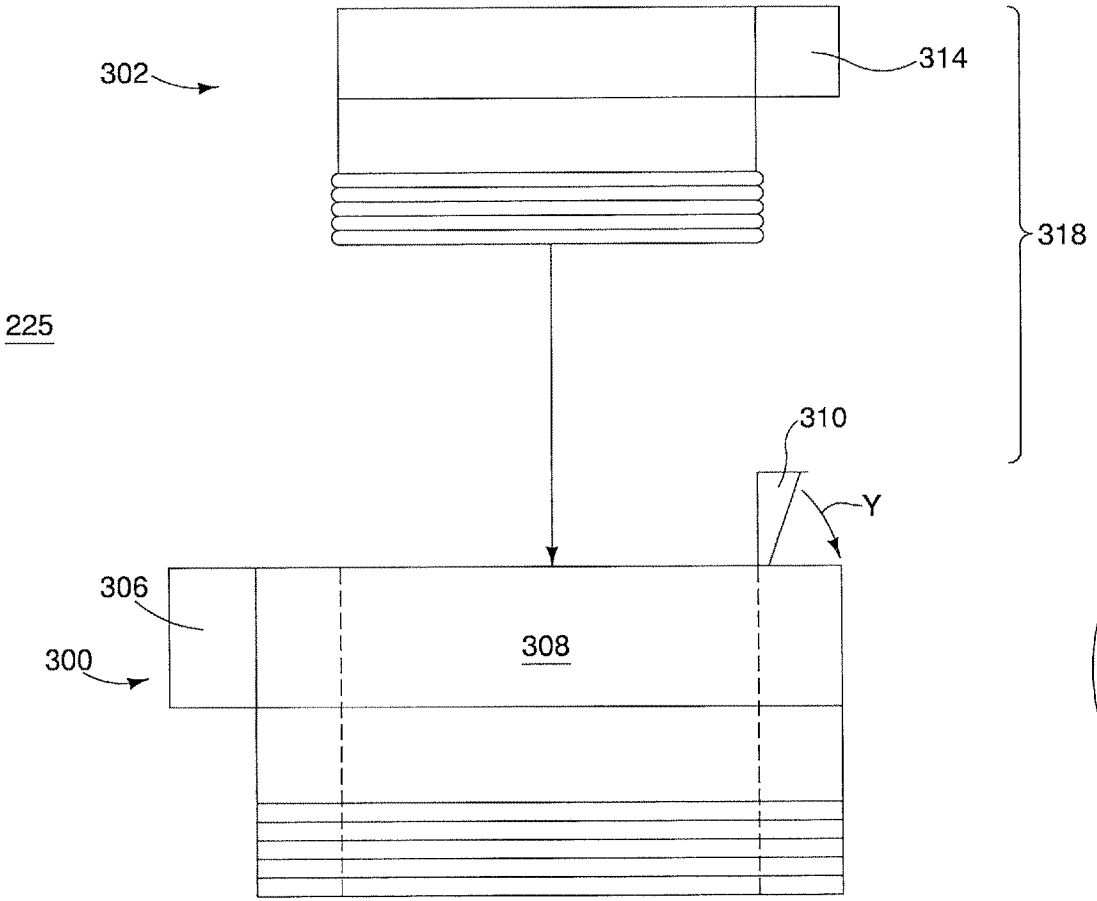
FIG. 10 is a side view of an example aperture cap for use with any of the fuel containers of FIGS. 1, 3 and 8*a*.

Another option of the container 110 provides one or more locks to prevent an unintentional discharge of the contents of the container 110. For example, an aperture cap 225 may comprise a first cap 300 and a second cap 302 (see FIG. 10). The first cap 300 comprises a series of threads, one or more ratchet teeth 306, a receiving aperture 308 (shown in stippled lines in FIG. 10) and a releasable boss 310. The first cap 300 is connectable to the container 110 by threading with matching threads that are positioned about the aperture 120, for example, on the external surface of the wall 112. While threading the first cap 300 on to the wall 112, the ratchet teeth 306 move in a first direction past a boss 312 that is positioned adjacent the aperture 112. For example, the boss 312 may be fixed to the wall 112 or the boss 312 may be fixed to a portion of the handle 114, 214 (see alternative configurations in FIG. 1 and FIG. 8*a*). The boss 312 prevents the ratchet teeth 306 from moving in a direction opposite to the first direction. Together the ratchet teeth 306 and the boss 312 act as a lock 301 to maintain the connection between the first cap 300 and the container 110.

The second cap 302 is releasably housed within the receiving aperture 308. The second cap 302 comprises threads that mate with matching threads on an inner surface of the receiving aperture 308. The second cap 302 comprises one or more ratchet teeth 314 that move in a first direction past the releasable boss 310 to lock the second cap 302 within the first cap 300. The releasable boss 310 can be deformed to release the one or more ratchet teeth 314 (for example, see Arrow Y in FIG. 10). Releasing the one or more ratchet teeth 314 allows the second cap 302 to be rotated in the opposite direction to the first direction and released from the receiving aperture 304. Together the ratchet teeth 314 and the releasable boss 310 act as a releasable lock 318. Optionally, for an operator to deform the releasable boss 310 requires a level of dexterity and/or finger strength that prevents an unintentional release of the releasable lock 318 and removing the second cap 302 from the first cap 300. For example, the releasable lock 318 can act as a child safety lock.

As an option of the first cap 300, the receiving aperture 308 has a sufficient diameter to allow the extendable tube 128, 228 to pass therethrough with, or without, an annular seal to prevent the leak of any fluids between the receiving aperture 308 and the external surface of the extendable tube 128, 228. In other embodiments, caps with different locking structures may be provided.

Figure 11:
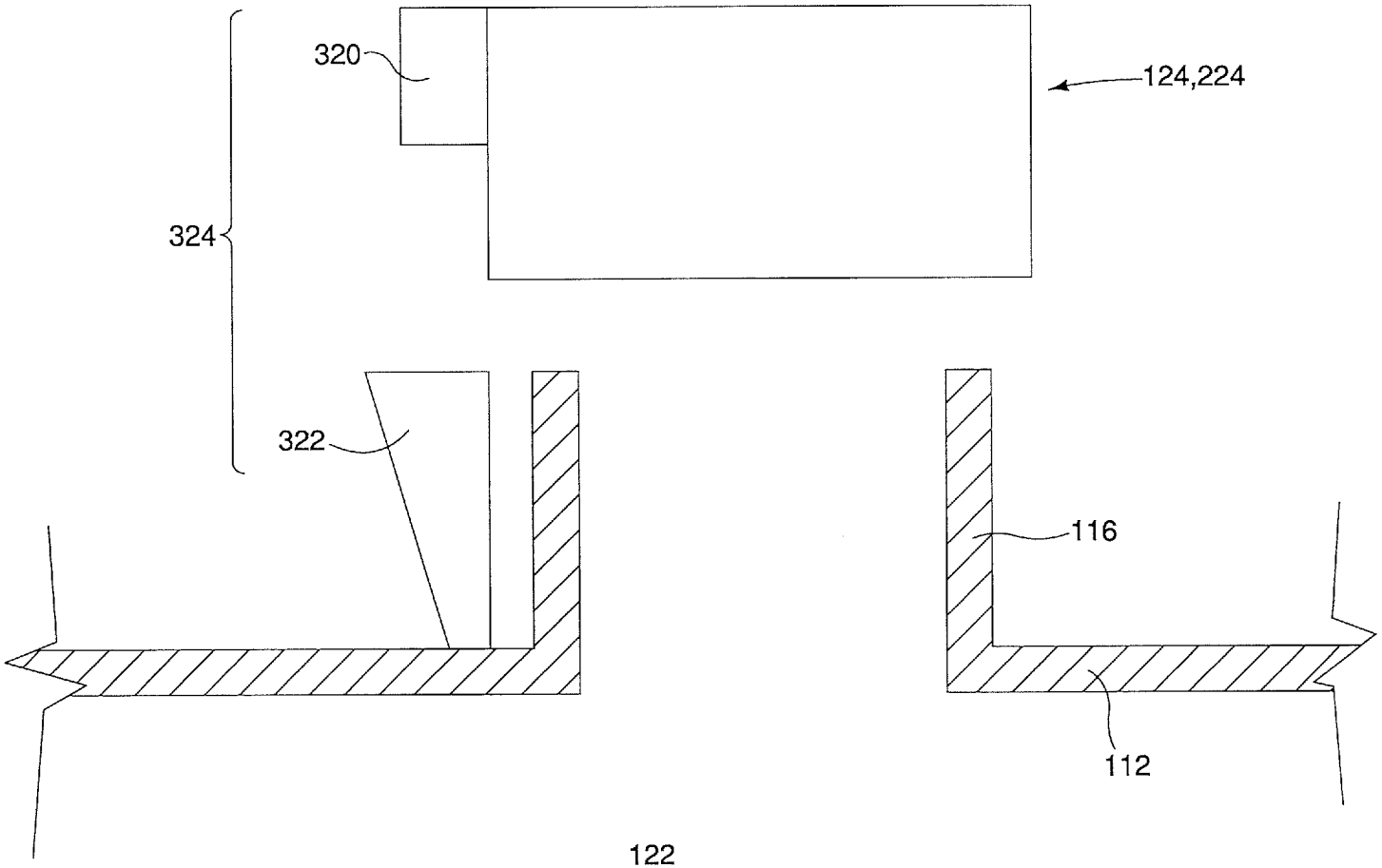
FIG. 11 is a side view of an example fill port cap for use with any of the fuel containers of FIGS. 1, 3 and 8*a*.

As a further option of the container 110, the fill port cap 124, 224 comprises one or more ratchet teeth 320 (see FIG. 11). The fill port cap 124, 224 can be connected to the fill port 116 by matched threads, snap fit, press fit, friction fit, or a combination thereof. When the operator connects the fill port cap 124, 224 to the fill port 116, the one or more ratchet teeth 320 can move in one direction past a second releasable boss 322 that is positioned adjacent the fill port 116 on the external surface of the wall 112. The second releasable boss 322 can be deformed to release the one or more ratchet teeth 320, which allows the fill port cap 124, 224 to be removed from the fill port 116. Together the one or more ratchet teeth 320 and the releasable boss 322 act as a releasable lock 324. Optionally, for an operator to deform the releasable boss 322 requires a level of dexterity and/or finger strength that prevents an unintentional release of the releasable lock 324 and removing the fill port cap 124, 224. For example, the releasable lock 324 can act as a child safety lock.

As a further option of the container 110, the trigger assembly 204 further comprises a trigger lock 326 that prevents the operator from actuating the trigger assembly 204. FIG. 9 depicts one example of the trigger lock 326 that comprises a blocking arm 328 and a spring 330 (depicted in stippled lines). The blocking arm 328 is pivotally connected to a portion of the handle 114, 214 (note that only handle 214 is depicted in FIG. 9). In the example illustrated in FIG. 9, the blocking arm 328 is connected by a screw or the like through the middle portion thereof, but in other embodiments the blocking arm may be connected by a screw or the like at or near one of the ends thereof. The blocking arm 328 can pivot between a blocking position and an open position (shown by the arrows in FIG. 9). The spring 330 is positioned about the pivot point of the blocking arm 328 with a first end 332 fixed to the blocking arm 328 and a second end 334 that is fixed to the handle 114, 214. In the blocking position, the blocking arm 328 is adjacent the trigger handle 208 and prevents the operator from actuating the trigger handle 208 to open the valve assembly 118, 218. In the open position, the blocking arm 328 is moved away from the trigger handle 208, which allows the operator to actuate the trigger handle 208. Moving the blocking arm 328 to the open position compresses the spring 330 and brings the first and second ends 332, 334 of the spring 330 closer together. Releasing the blocking arm 328, while in the open position, allows the spring 330 to move the first and second ends 332, 334 away from each other, which moves the blocking arm 328 back into the blocking position. The spring 330 may be omitted in some embodiments, and the blocking arm 328 may be moved manually.

In another option of the container 110, the handle 114, 214 can be pivotally connected at both ends to the external surface of the wall 112, for example by a releasable hinge (not shown), to allow the handle 114, 214 to be pivoted away from a central, vertical plane of the container 110 to allow filling of the container 110 through the fill port 116.

FIG. 8*b* depicts another option of the container 110 with the fill port 116 positioned away from a central, vertical plane of the container 110 and away from the handle 214. In this configuration, the handle 214 can be positioned along the central line of the container 110 to facilitate an even distribution of the weight of the container 110 while positioning the fill port 116 in an easily accessible location of the container 110.

In another option of the valve assembly 218, the seal 202 can be fixed on the internal surface of the second tube 230. When the second tube 230 is in the closed position, the seal 202 is between the fluid flow aperture 200 and the hollow chamber 122. When the second tube 230 moves to the open position, the seal 202 will move past the fluid flow aperture 200 and the fluid pathway between the hollow chamber 122 and the internal spaces of the first and second tubes 228, 230 will open.

FIGS. 12 to 16C depict other embodiments of a valved fluid container that includes a hollow vessel 10 having a spout aperture 10*a* formed in the front thereof and a first or pouring handle 12 oppositely disposed on the back of vessel 10. Pouring handle 12 has a corresponding first handle cavity 12*a* sized to accept the fingers 8 of the operator's hand when grasping pouring handle 12. Handle cavity 12*a* is defined in part by handle 12 and by oppositely disposed handle side wall 10*b*. Handle side wall 10*b* also forms a side wall of vessel 10. A shaft aperture 10*c* is formed in handle side wall 10*b*. Spout aperture 10*a*, shaft aperture 10*c*, and handle 12 all lie substantially in a common plane which bisects vessel 10 into mirror image halves.

Valve 14 is rigidly mounted in spout aperture 10*a* so as to also lie substantially in the common plane. Valve 14 is actuated by valve shaft 16 which is journalled through shaft aperture 10*c* and mounted at its hollow end 16*a* to valve outer sleeve 24 of valve 14, and at its opposite trigger handle end 16*b* to trigger handle 18.

Valve 14 includes three nested hollow tubes wherein the innermost or extendable tube is spout 20, the main or second tube is valve main body 22, and the third or outer tube is valve outer sleeve 24. Each of the three tubes; namely, spout 20, valve main body 22, and valve outer sleeve 24, each have opposite downstream and upstream ends, 20*a*, 20*b*, and 22*a*, 22*b*, and 24*a*, 24*b* respectively.

Spout 20 is telescopically nested within valve main body 22 for telescopic motion in direction B relative thereto. Valve outer sleeve 24 is telescopically mounted on valve main body 22 so as to provide a second telescopic motion in direction C of valve outer sleeve 24 relative to valve main body 22. Valve main body 22 is rigidly mounted into spout aperture 10*a* of vessel 10. The telescopic motions of spout 20 and valve outer sleeve 24 in directions B and C respectively are along valve longitudinal axis D which extends centroidally through valve 14 and valve shaft 16, and wherein axis D intersects handle 12 and corresponding handle cavity 12*a*.

The hollow end 16*a* of valve shaft 16 is mounted to the upstream end 24*b* of valve outer sleeve 24 so that translation of valve shaft 16 in direction E, for example by the operator pulling trigger handle 18 away from handle side wall 10*b*, imparts a corresponding translation of valve outer sleeve 24 in direction C. Thus, valve outer sleeve 24 may be translated between its seal open position of FIG. 14 and its seal closed position of FIG. 13, wherein, respectively, primary and secondary seals 26, 28, shown as O-rings although this is not intended to be limiting as one skilled in the art would know that other forms of seals would also work, to form fluid inhibiting seals between downstream ends 22*a* and 24*a* and between upstream ends 22*b* and 24*b*.

With valve outer sleeve 24 in its seal closed position, so that seals 26 and 28 are closed, fluid is inhibited from flowing from the interior 10*d* of vessel 10 through primary aperture 22*c* in valve main body 22 and corresponding aperture 20*c* in spout 20, and air is inhibited from flowing through secondary apertures 22*d* of valve main body 22.

Locking dogs 32 releasably lock valve outer sleeve 24 when in its seal closed position. Advantageously, locking dogs 32 are actuated so as to lock valve outer sleeve 24 in its seal closed position by the retraction of spout 20 into its storage position fully recessed within valve main body 22. In particular, resilient locking dogs 32 are engaged by upstream end 20*b* of spout 20 when spout 20 is seated within upstream end 22*b* of valve main body 22.

Figure 12:
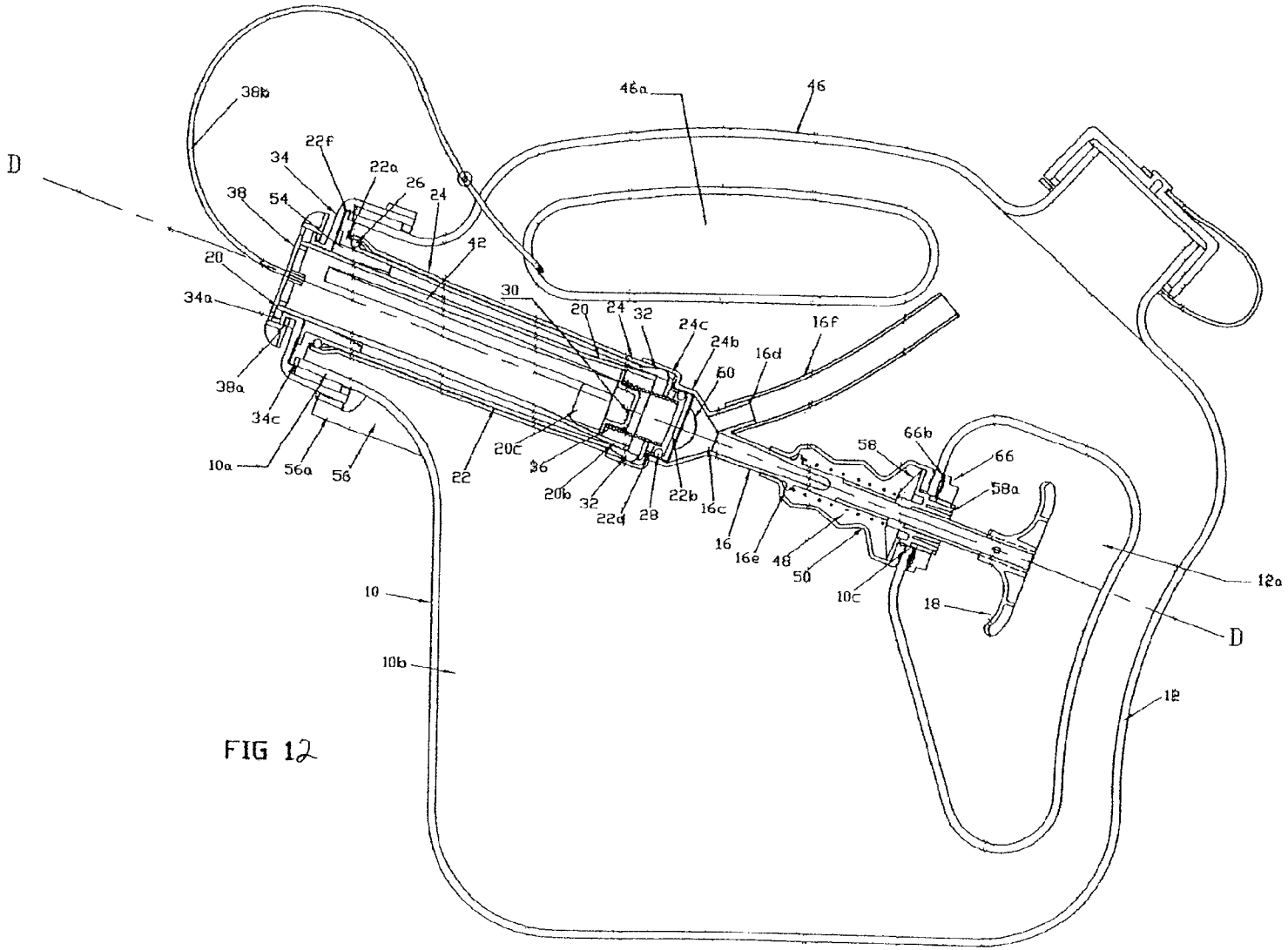
FIG. 12 illustrates a side, longitudinal sectional view of a preferred embodiment of the fluid transport container of the present invention.
Figure 12A:
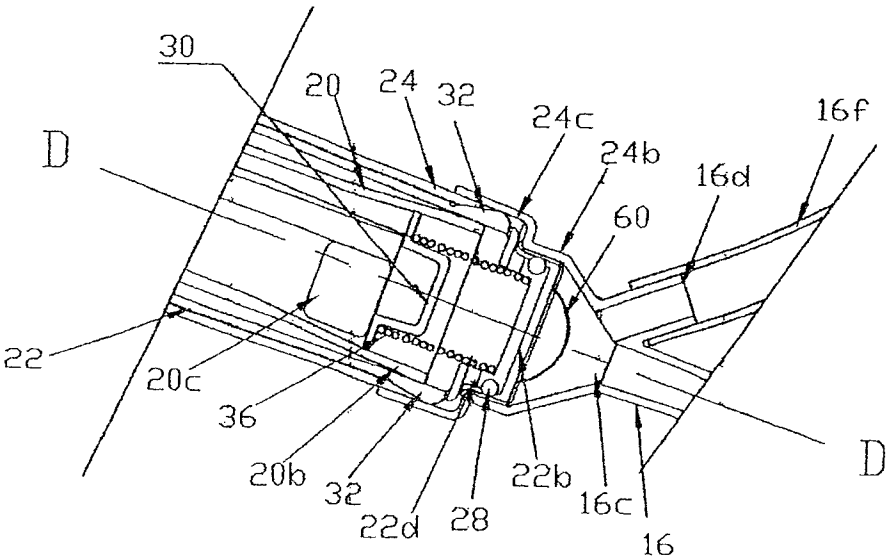
FIG. 12*a* is an enlarged view of a portion of FIG. 12 showing the valve lock.
Figure 13:
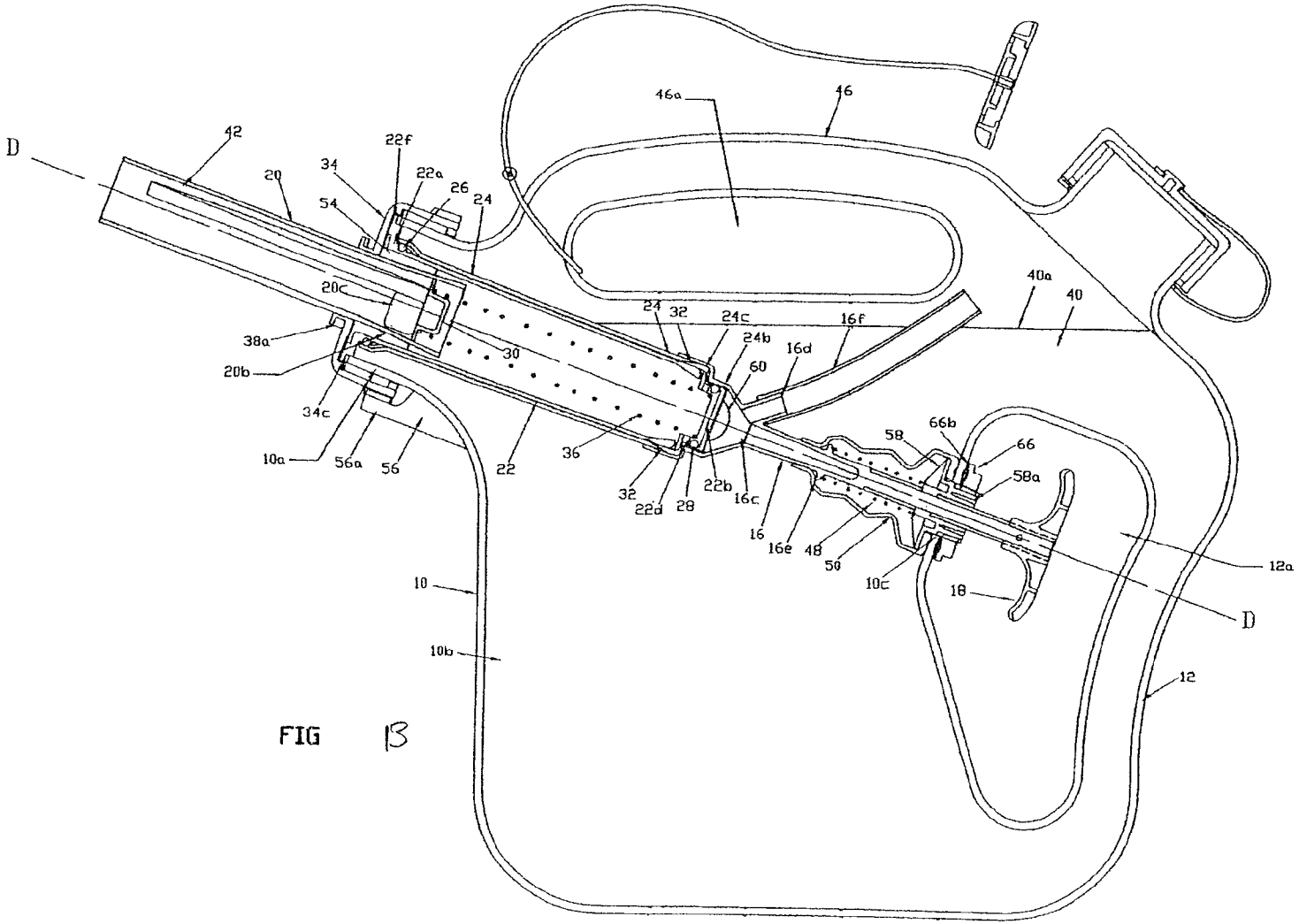
FIG. 13 illustrates the vessel of FIG. 12 with the spout released and extended out of the valve body, ready for dispensing fluid, showing, in section, the operator grasping the pouring handle and trigger handle.
Figure 13A:
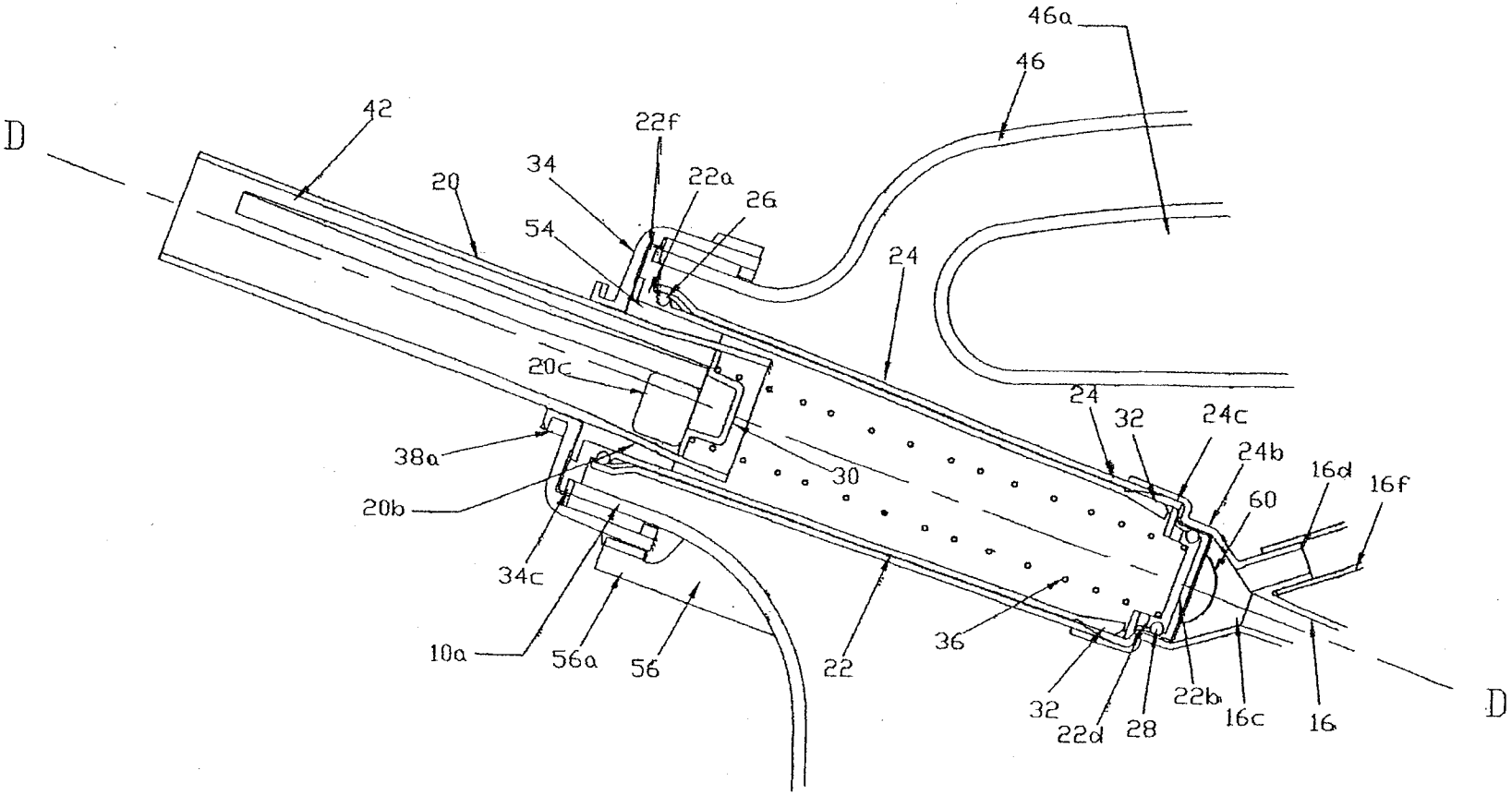
FIG. 13*a* is an enlarged view of a portion of FIG. 13 showing the valve seals.
Figure 13B:
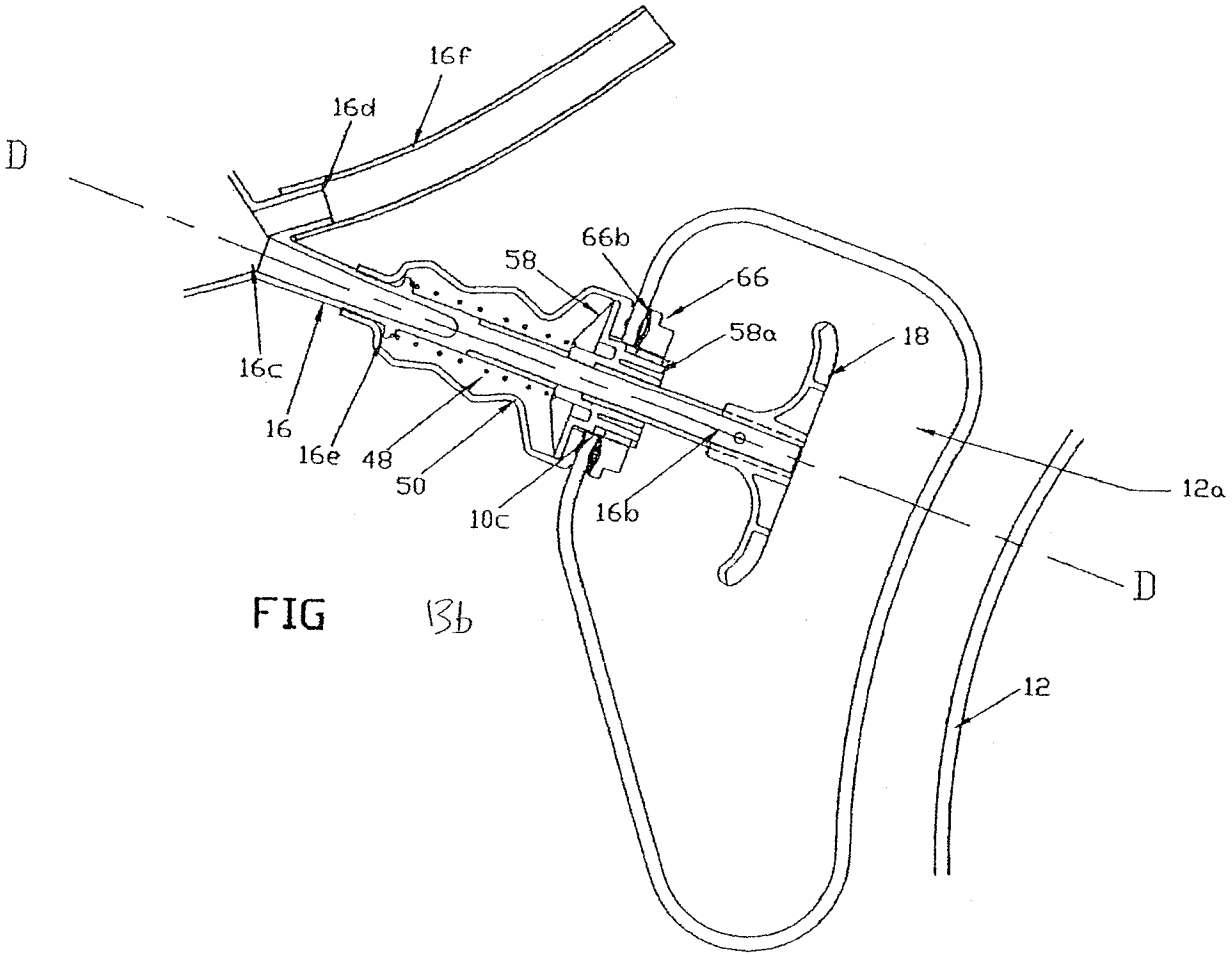
FIG. 13*b* is an enlarged view of a portion of FIG. 13 showing the trigger and valve shaft.

In one embodiment, when spout 20 is in its storage position such as seen in FIG. 12, the downstream end 20*a* is substantially flush with a valve retaining cap 34 mounted over spout aperture 10*a*. Seating of upstream end 20*b* of spout 20 so as to be nested and mated within upstream end 22*b* of valve main body 22, resiliently biases locking dogs 32 into correspondingly positioned notches or grooves 24*c* or other female depressions formed in the upstream end 24*b* of valve outer sleeve 24.

As spout 20 telescopically extends from valve main body 22, upstream end 20*b* releases from its biasing engagement against resilient locking dogs 32 thereby disengaging dogs from locking engagement in grooves 24*c*. Unlocked valve outer sleeve 24 may then be actuated by valve shaft 16 so as to translate valve outer sleeve 24 from its seal closed position into its seal open position.

In one embodiment, which is not intended to be limiting, a spout ejection spring 36, which may as illustrated be a helical coil spring, is mounted in upstream end 22*b* of valve main body 22 so as to act upon spring plug 30 which may be inserted within the upstream end 20*b* of spout 20 thereby resiliently biasing spout 20 into its extended position extended from valve main body 22. Thus in order to engage locking dogs 32 so as to lock valve outer sleeve 24 into its seal closed position on valve main body 22, spout 20 is retracted into its storage position against the return biasing force of spout ejection spring 36. In order to store vessel 10 with spout 20 retracted and valve outer sleeve 24 thereby locked, a spout retainer is employed so as to releasably lock spout 20 in its stored position retracted within valve main body 22. In the illustrated embodiment, which is not intended to be limiting, the spout retainer is a spout retaining cap 38 which releasably mounts onto valve retaining cap 34 so as to cover the opening into downstream end 20*a* of spout 20.

Spring plug 30 may substantially close off the upstream 20*b* end of spout 20 fluid passage. This function assists in preventing the fluid 40 that is exiting from container 10 through apertures 22*c* and 20*c* and into the inner fluid cavity passage of the spout 20 from flowing over the dividing wall and into the separate air channel 42. Thus the exiting fluid may be directed toward the downstream end 20*a* of spout 20 without divergence. Further the spring plug provides a surface for the resilient spout spring 36 to act against in its function of ejection of the spout 20. The air channel 42 is continuous through and not blocked by the spring plug.

Figure 14:
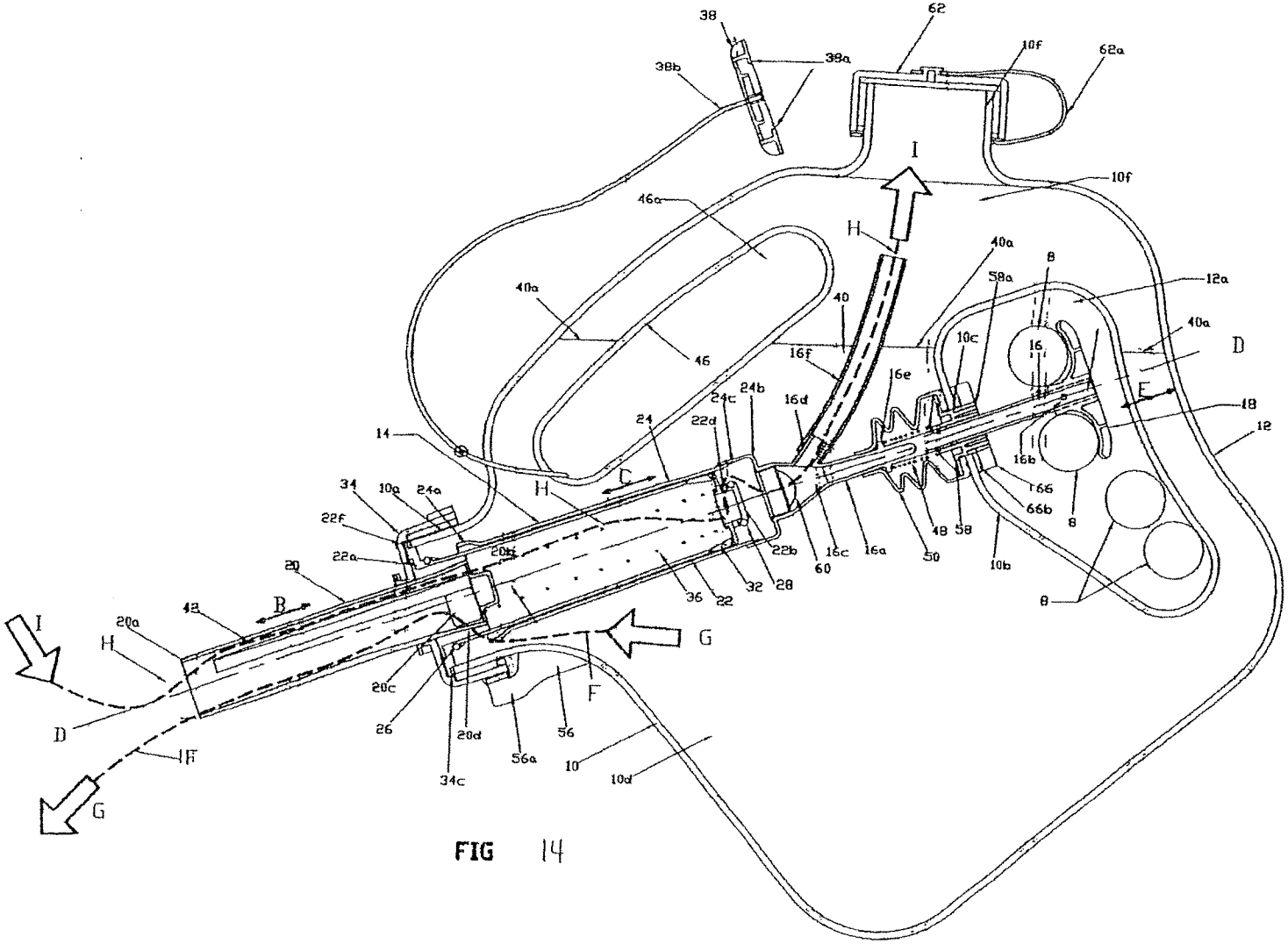
FIG. 14 illustrates the vessel of FIG. 13 with the vessel inclined at a typical pouring angle and the valve in the open position, and showing in dotted lines the path of the fluid flowing out of the vessel and the air flowing into the vessel.
Figure 15B:
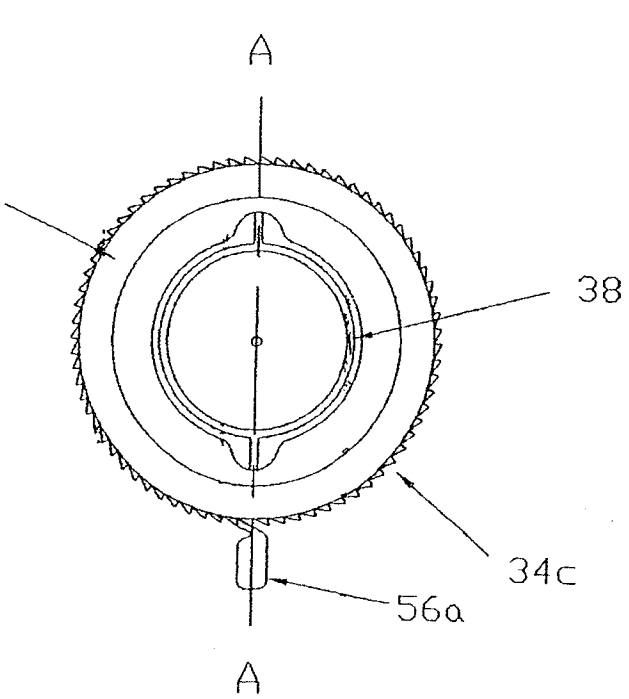
FIGS. 15*a* and 15*b* illustrate respectively two end views of the valve cap.
Figure 15A:
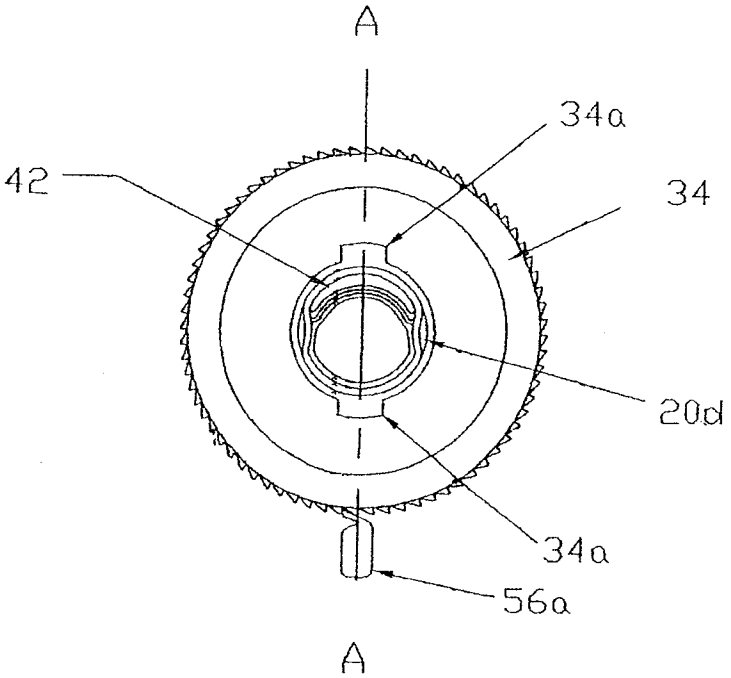
Figures 16A, 16B, 16C:
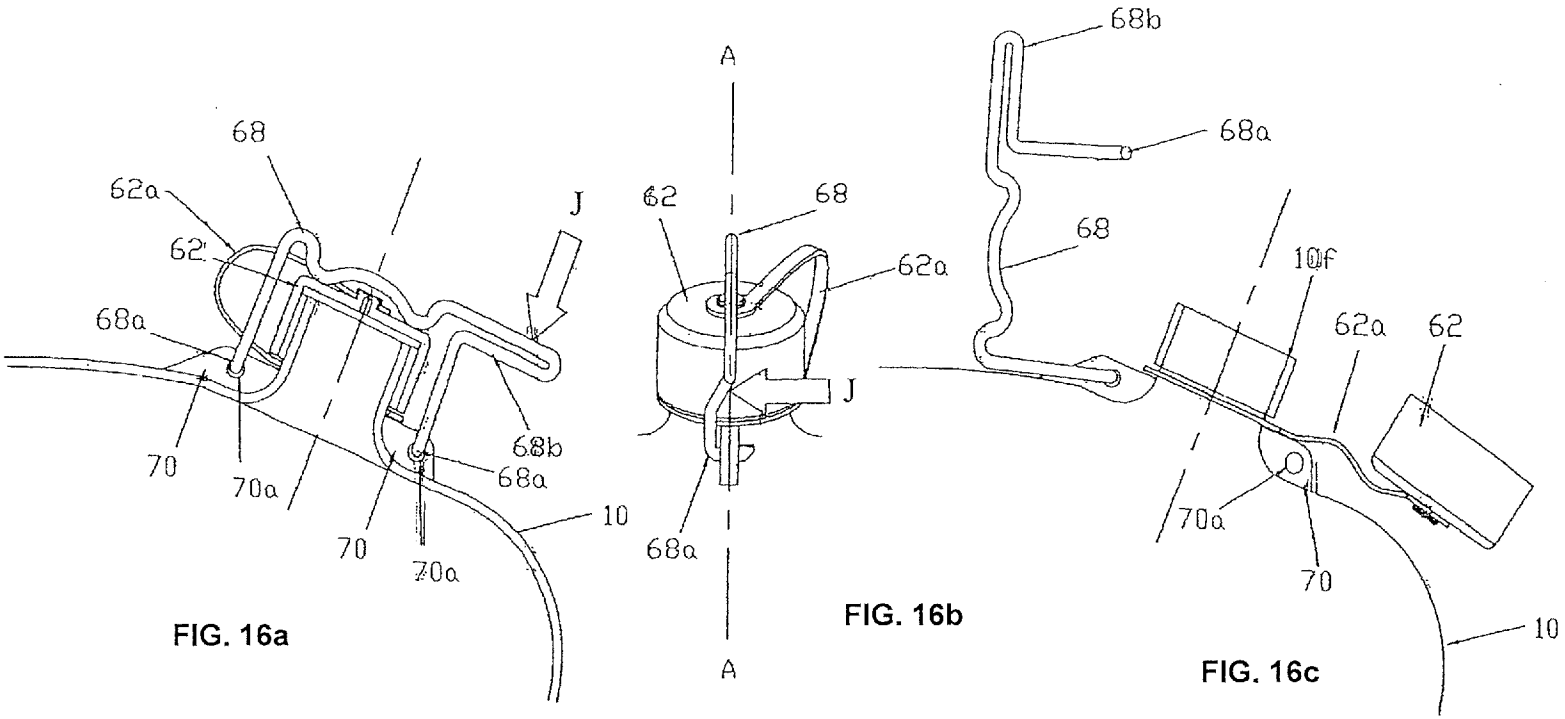
FIG. 16*a* illustrates in side sectional view the fill cap and safety spring lock for the cap on the top of the vessel.
FIG. 16*b* illustrates, in perspective view, the cap and safety lock of FIG. 16*a*.
FIG. 16*c* illustrates the cap and safety lock of FIG. 16*a*, with the cap and safety lock removed from the fill spout on top of the vessel.

As best seen in FIG. 14, when fluid 40 is stored within vessel 10 so that the fluid level 40*a* is above valve 14, and in particular above primary aperture 22*c* on valve main body 22 when vessel 10 is forwardly tilted into its pouring position with axis D downwardly forwardly inclined and when trigger handle 18 is retracted towards pouring handle 12 so that valve shaft 16 retracts valve outer sleeve 24 into its seal open position, fluid 40 flows through primary aperture 22*c* on valve main body 22 and through aperture 20*c* on spout 20, for example along the illustrated fluid path F in direction G so as to decant fluid 40 from spout 20.

An air channel 42 is preferably provided within spout 20, advantageously adjacent the upper side, and in the illustrated embodiment contained within spout 20, so as to allow the ingress of air, for example along airflow path H in direction 1. Thus with axis D forwardly and downwardly inclined so as to pour fluid 40 from spout 20, the volume of fluid exiting vessel may be replaced with a corresponding volume of air flowing through air channel 42 and thence upwardly along valve main body 22 so as to exit via secondary apertures 22*d* in valve main body 22 into hollow end 16*a* of valve shaft 16.

Air passage 16*c* extends along and within valve shaft 16 from hollow end 16*a* towards trigger handle end 16*b*. At least one port 16*d* is formed in valve shaft 16 in airflow communication with air passage 16*c* so that airflow along airflow path H may escape through port 16*d*, illustrated in FIG. 14. Port 16*d* may include an extension such as a flexible tube 16*f* to extend the air passage 16*c* upward towards and in some instances above the surface of the contained fluid 40 surface 40*a* in the passageway within vessel 10 formed between handle cavity 12*a* of pouring handle 12 and handle cavity 46*a* of carrying handle 46. Advantageously, port 16*d* is disposed upwardly.

In one embodiment, a valve spring 48, which may, as illustrated be a helical coil spring, or other resilient biasing means, act on valve shaft 16 so as to resiliently bias valve outer sleeve 24 into its seal closed position. Thus an operator pulling on trigger handle 18 so as to retract handle 18 and valve shaft 16 towards pouring handle 12, retracts valve outer sleeve 24 into its seal open position against the resilient return biasing force of valve spring 48. Valve spring 48, the corresponding portion of valve spring 16, and shaft aperture 10*c*, may be closed within a resilient sealing boot 50.

The location of the trigger handle provides significant safety, protection from damage if the vessel falls or is dropped, as the pouring handle will help protect the trigger handle from impact and possible damage.

Spout retainer cap 38 may be held in place on valve retaining cap 34 by two tabs 38*a* on the underside of spout retainer cap 38 that engage within sockets 34*a* on the valve retaining cap 34. Spring 36 acting on spout 20 holds the cap 38 in place, engaging tabs 38*a* within sockets 34*a*. Releasing retaining cap 38, by disengaging tabs 38*a* from sockets 34*a* allows spout 20 to freely extend from inside valve main body 22. Retaining cap 38 may be attached to vessel 10 via a tether 38*b*.

Spout ejection spring 36 acts, at least in part, against spring plug 30. Spout 20 is ejected by spring 36 until tapered upstream 20*d* end of spout 20 engages with a corresponding tapered surface within spout keeper bushing 54 stopping further extension of spout 20. A pair of opposed flat faces on spout 20 engage in and ride along a corresponding pair of longitudinally extending flat faces in the small bore of spout keeper bushing. Flat faces 20*d* on spout 20 extend along approximately ¾ of the length of spout 20 from the downstream end 20*a* of spout 20. Thus when spout 20 is stopped by the tapered faces of spout keeper bushing 54 from further extension from valve main body 22 a short approximately ¼ of the length of spout 20 is retained within downstream end 22*b* of valve main body 22, at which point primary apertures 20*c* and 22*c* are aligned on spout 20 and valve main body 22 respectively communicating through substantially similarly placed apertures in spout keeper bushing 54. The flat faces of spout keeper bushing 54 which are slideably mated in grooves 20*d* prevent the rotation of the spout 20 relative to valve retaining cap 34. Thus air channel 42 is maintained in an orientation uppermost in spout 20.

The operator may either support vessel 10 by holding the carrying handle 46 or by holding the pouring handle 12 and, as necessary, also supporting the front of vessel 10 under front boss 56. The operator positions the downstream end 20*a* of the spout 20 in the location where fluid 40 is required before pulling of trigger handle 18.

Valve spring 48 may in one embodiment be mounted between collar 16*e* on shaft 16 and shaft support bushing 58.

Trigger handle 18, when pulled, slides shaft 16 through the bore of support bushing 58. The bore of support bushing 58 may be keyed or otherwise formed to prevent the rotation of shaft 16.

Because it is likely that vessel 10 will distort due to heating and cooling, valve spring 48 is located and mounted such that, even when vessel 10 is distorted, such as when temperatures and vapours expand and contract within the vessel, valve spring 48 maintains a sufficient force upon shaft 16 and thus on valve outer sleeve 24 to maintain the primary and secondary seals 26, 28 closed. In a preferred embodiment such as seen in FIG. 14, air flow along path H passes through a non-flammable screen such as flashback arrestor 60. Arrestor 60 may be included as a safety feature to assist in the prevention of ignition of fumes within vessel 10.

Port 16*d* in the shaft 16 is preferably disposed upwardly. The placement of port 16*d* at this greater distance from primary apertures 20*c*, 22*c* allows inflow of air behind the mass of out-flowing fluid 40, allowing air into the space behind the out-flowing fluid 40 which prevents formation of a vacuum within vessel 10. The use of air channel 42 as a separate air passage through spout 20 reduces the tendency for the incoming air to force its way back through the outward flow of fluid in spout 20 so as to cause gulping of air and thus interruption of a smooth flow of liquid out of the spout. The addition of an extension air tube 16*f* onto port 16*d* allows for an uninterrupted air passage to the back and uppermost portion of the vessel inner cavity 10*f*. This extension of the air passage H substantially eliminates the occurrence of fluid entering the air passage from the upstream end.

One end of sealing boot 50 is snugly mounted for a friction fit onto shaft 16, adjacent port 16*d* creating a vapour and fluid seal. Sealing boot 50 is sealed to the handle side wall 10*b* at bushing 58. The sealing boot 50 is clamped between bushing 58 and handle side wall 10*b* by threaded post 58*a* journalled through shaft aperture 10*c*. Nut 66 threads onto the post 58*a* and clamps lock washer 66*b* against handle side wall 10*b*. Aperture 10*c* and bushing 58 threaded post 58*a* are shaped to prevent rotation of post 58*a* in aperture 10*c*. For example, aperture 10*c* may be a D shaped hole.

Valve retaining cap 38 may include a lock to prevent accidental opening of the valve retaining cap. Valve securing boss 56, located on vessel 10 below threaded spout boss 10*a*, may include a protrusion or arm 56*a* which lies adjacent a sidewall 34*b* of valve retaining cap 34. Teeth 34*c* or other ratcheting means are mounted around sidewall 34*b*. Teeth 34*c* engage in a ratcheting cooperation with arm 56*a*. Thus teeth 34*c* lock against arm 56*a* to prevent the unthreading and unwinding of cap 38 from threaded spout boss 10*a*. Collar 22*f* is formed as an annular ring around downstream end 22*a* and is mounted onto the end of threaded spout boss 10*a* by cap 38 clamping collar 22*f* onto gasket 34*c*.

Filler cap 62 is mounted onto vessel 10 by threading cap 62 onto threaded filler boss 10*f* formed on the top of vessel 10. A securing strap 62*a* retains filler cap 62 on boss 10*f* when the cap is unthreaded and removed from the opening into boss 10*f*.

A securing spring clamp 68 may be provided to inhibit a child tampering with or opening filler cap 62. Spring clamp 68 straddles filler cap 62. The ends 68*a* of spring clamp 68 may be mounted by hooking ends 68*a* in apertures 10*a* in gussets 70 on either side of boss 10*f*. One end 68*a* may be unhooked from its corresponding aperture 70*a* by pushing down in direction J on a lever arm 68*b* formed so as to be cantilevered from the corresponding side of spring clamp 68. This releases the tension holding end 68*a* hooked in aperture 70*a*, so that the end 68*a* may be released from its aperture 70*a*.

As will be apparent to those skilled in the art in the light of the foregoing disclosure, many alterations and modifications are possible in the practice of this invention. Accordingly, the scope of the invention is to be construed in accordance with the substance defined by the following claims. The scope of the claims should not be limited by the example embodiments discussed above, but should be given the broadest interpretation consistent with the description as a whole.

What is claimed:

1. A container comprising:

a. a wall that defines a hollow chamber and an aperture that extends through the wall;

b. a valve assembly disposed in the aperture, the valve assembly comprising:

i. an extendable tube that is moveable between a retracted position wherein the extendable tube is substantially within the hollow chamber, and an extended position wherein at least part of the extendable tube extends through the aperture;

ii. a biasing member coupled to the extendable tube for moving extendable tube toward the extended position;

iii. a flow rate adjuster cooperating with the extendable tube, and comprising a second tube sized to fit over the extendable tube, the second tube moveable between an open position and a closed position; and iv. a trigger assembly coupled to the second tube for moving the second tube between the open position and the closed position.

2. The container of claim 1, further comprising an aperture cap with a releasable lock.

3. The container of claim 1, further comprising an aperture cap having a first cap portion that is attached about the aperture and a second cap portion that is releasably housed within the first cap portion.

4. The container of claim 3, wherein the second cap portion holds the extendable tube in the retracted position against the force of the biasing member.

5. The container of claim 1, further comprising an airflow regulator regulating flow of air between the hollow chamber and outside of the container.

6. The container of claim 5 wherein the airflow regulator comprises a bidirectional valve assembly.

7. The container of claim 6, wherein the wall further defines a fill port, and wherein the bidirectional valve assembly is positioned in a fill port cap which covers the fill port.

8. The container of claim 6, wherein the bidirectional valve assembly is positioned in the wall.

9. The container of claim 5 wherein the airflow regulator comprises an air channel formed in the extendable tube.

10. The fuel container of claim 9, wherein the air channel is formed by a separation wall that is positioned within the extendable tube.

11. The container of claim 1, wherein the flow rate adjuster comprises a fluid control aperture near an inner end of the extendable tube, and a structure within the hollow chamber for selectively covering the fluid control aperture.

12. The container of claim 11 wherein the second tube comprises a first end for selectively abutting the wall around the aperture, and a closed second end, and wherein when the second tube is in the closed position the first end abuts the wall.

13. The container of claim 12, further comprising a second biasing member for moving the second tube into the closed position.

14. The container of claim 1, further comprising a handle that extends from an external surface of the wall, wherein the trigger assembly comprises a trigger handle that is positioned between the handle and the external surface of the wall.

15. The container of claim 14, further comprising a trigger guide that restricts the trigger assembly to move along a preferred path of travel.

16. The container of claim 14 wherein the trigger handle is coupled to a trigger shaft extending through a trigger shaft aperture in the wall to connect the trigger handle to the second tube.

17. The container of claim 16 wherein a portion the wall proximate to the trigger shaft aperture is more rigid than other portions of the wall.

18. The container of claim 14, wherein the trigger assembly comprises a trigger lock.

19. The container of claim 18, wherein the trigger lock comprises a pivotable blocking arm and a spring that moves the blocking arm into a blocking position.

* * * * *